US010732568B2

(12) United States Patent
Hasegawa

(10) Patent No.: US 10,732,568 B2
(45) Date of Patent: Aug. 4, 2020

(54) IMAGE HEATING APPARATUS

(71) Applicant: CANON KABUSHIKI KAISHA, Tokyo (JP)

(72) Inventor: Takuya Hasegawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/384,576

(22) Filed: Apr. 15, 2019

(65) Prior Publication Data

US 2019/0317449 A1 Oct. 17, 2019

(30) Foreign Application Priority Data

Apr. 16, 2018 (JP) ..... 2018-078304

(51) Int. Cl.
*G03G 21/20* (2006.01)

(52) U.S. Cl.
CPC ..... *G03G 21/206* (2013.01)

(58) Field of Classification Search
CPC ..... G03G 21/206; G03G 15/2017; G03G 2221/1645
See application file for complete search history.

(56) References Cited

U.S. PATENT DOCUMENTS 9,268,269 B2 2/2016 Sekiya

FOREIGN PATENT DOCUMENTS

JP 2008-003141 A 1/2008
JP 2015-158600 A 9/2015

OTHER PUBLICATIONS

JP 2008003141 English machine translation, Uehara, Jan. 10, 2008 (Year: 2008).*

* cited by examiner

*Primary Examiner* — Thomas S Giampaolo, II
(74) *Attorney, Agent, or Firm* — Venable LLP

(57) ABSTRACT

An image heating apparatus including an image heating member, an air blowing portion, a duct, a shutter, a detecting sensor, and a controller. The image heating apparatus also includes a plurality of projections having a smallest projection or a plurality of recessed portions having a smallest recessed portion. The controller is configured to control an operation of the shutter so that the controller stops the shutter on the basis of detection of the smallest projection or smallest recessed portion by said detecting sensor during closing of said shutter.

18 Claims, 20 Drawing Sheets

(a)FULL-CLOSE (b)FULL-CLOSE

IMAGE HEATING APPARATUS

FIELD OF THE INVENTION AND RELATED ART

The present invention relates to an image heating apparatus including an air blowing, cooling mechanism and relates to an image forming apparatus. This image heating apparatus is capable of being used as a fixing device for heat-fixing a toner image formed on a recording material. This image heating apparatus may be mounted in an image forming apparatus of an electrophotographic type, for example, such as a copying machine, a printer, a facsimile machine, or a multi-function machine having a plurality of functions of these machines.

For example, in an electrophotographic image forming apparatus, an unfixed toner image is formed on a sheet-like recording material (sheet) or paper by an image forming means, and thereafter, is fixed as a fixed image by a fixing means.

As a type of the fixing means, various types have been proposed, but a fixing device of a heat and pressure type in which the toner image is fixed under application of heat and pressure has been used in general. This fixing device includes a rotatable heating member (fixing roller, fixing film, or the like) to be heated by a heating means and a rotatable pressing member (pressing roller, or the like) for forming a fixing nip in press-contact with the rotatable heating member. Then, both the rotatable members are rotated, and a sheet on which the unfixed toner image is carried is guided into the fixing nip. The sheet is nipped and fed through the fixing nip so that the toner image is fixed on a surface of the sheet by the heat of the rotatable heating member and nip pressure.

In such a fixing device, in the case where small-size sheets are continuously passed through the fixing device and thus fixing is carried out, a surface temperature excessively increases in a non-sheet-passing region (non-contact region with the sheet) of the rotatable heating member. The small-size sheets are smaller in width than maximum-size sheets which can be passed through the fixing device and which have a maximum width. Here, the non-sheet-passing region (non-sheet-passing portion) is a region of the rotatable heating member which does not contact the small-size sheets when the small-size sheets are passed through the fixing device.

When the small-size sheets are continuously passed through the fixing device, heat is partly accumulated in the non-sheet-passing region through which the sheets do not pass, as not heat is extracted by the sheets in this region. This phenomenon is called end portion temperature rise or non-sheet-passing portion temperature rise of the fixing device, and when this end portion temperature rise becomes a high temperature level, it leads to an occurrence of hot offset and thermal deterioration of the constituent component parts of the fixing device.

As one of countermeasures against this non-sheet-passing portion temperature rise, a mechanism in which a cooling fan for cooling the non-sheet passing portion is provided has been known. Japanese Laid-Open Patent Application (JP-A) 2008-3141 discloses a construction in which ducts for permitting blowing of air from cooling fans are provided at left and right sides of a fixing roller with respect to a longitudinal direction and in which shutters capable of opening and closing openings of the ducts are provided. In JP-A 2008-3141, each of the shutters is moved to a position depending on a width size of the sheet, and the air is blown by the cooling fan depending on a temperature detected by an element for detecting a temperature of a non-sheet-passing portion of the fixing roller. Thus, a cooling range is adjusted by moving the shutter, so that the non-sheet-passing portion temperature rise is suppressed.

Further, in JP-A 2008-3141, the shutters adjust the cooling ranges of the fixing roller by blocking the air blown by the cooling fans. The shutters are disposed on one end side and the other end side (left and right sides) with respect to a direction perpendicular to the longitudinal direction (sheet passing direction) of the fixing roller.

A shutter structure of JP-A 2008-3141 includes two sensors consisting of a sensor for detecting a home position (HP) of the shutter and a sensor for controlling a position of the shutter which are separately provided. In this shutter structure, a cost corresponding to two photo-sensors is required in order to achieve a function of a shutter opening and closing operation.

That is, the shutter structure of JP-A 2008-3141 includes the photo-sensor (sensor for detecting the HP of the shutter) for detecting a shutter-closed state which is a reference position (home position) of the shutter during OFF/ON of a voltage source of an image forming apparatus main assembly.

Further, in the shutter structure of JP-A 2008-3141, a plurality of edge portions that correspond to various width size sheets are provided at a folded edge portion of one of the two shutters on the left and right sides (on one end side and on the other end side). The photo-sensor (sensor for controlling the position of the shutter) for detecting the edge portions is provided fixedly to a frame.

The left and right shutters are moved by controlling a shutter motor in normal rotation or in reverse rotation so that the edge portions corresponding to width size information of sheets used are detected by the photo-sensor. Then, drive of the shutter motor is stopped at the time when the edge portions corresponding to the width size information of sheets used are detected. As a result, the left and right shutters are moved to positions corresponding to the width of the sheet used.

Further, as a control method using only a single photo-sensor, a method in which only a photo-sensor for detecting a home position is provided and the shutter position is controlled on the basis of the number of rotation pulses of a shutter motor corresponding to the width size information of the sheet used has also been known. That is, a construction in which only the sensor (one sensor) for detecting the HP of the shutter is provided and the shutter position is controlled only by the number of pulses of the motor from the HP without being detected by the sensor is employed.

However, in this control method, in the case where the shutter motor is out of step due to an accidental negative load and thus rotation thereof is stopped, there is a liability that an opening position of the shutter stops at a position which is not an assumed position and is in a state in which the end portion temperature rise cannot be suppressed.

SUMMARY OF THE INVENTION

A principal object of the present invention is to provide an image heating apparatus capable of carrying out detection of a home position of a shutter and control of a shutter position by a single sensor.

According to an aspect of the present invention, there is provided an image heating apparatus that includes an image heating member, an air blowing portion, a duct, a shutter, a detecting portion, a plurality of projections, and a controller.

The image heating member is configured to heat an image on a recording material. The duct is configured to guide air from the air blowing portion toward an end portion of the image heating member with respect to a longitudinal direction of the image heating member. The shutter is configured to open and close an opening of the duct while sliding on the duct through the opening of the duct. The detecting portion is configured to detect a position of the shutter with respect to a sliding direction and to detect that the shutter is closed the plurality of projections is movable together with the shutter and configured to be detected by the detecting portion so as to set a width of the opening. The plurality of projections include a smallest projection having a width smallest among widths of the projections with respect to a movement direction of the projections. The controller is configured to control drive of the shutter on the basis of a signal detecting the projections by the detecting portion, wherein the controller stops the drive of the shutter at a time when the smallest projection passes a detecting position of the detecting portion during closing of the shutter.

Further features of the present invention will become apparent from the following description of exemplary embodiments with reference to the attached drawings.

BRIEF DESCRIPTION OF THE DRAWINGS

Parts (a)-(b) and (c) of FIG. 1 are illustrations of a shutter position detecting means in an air blowing cooling mechanism in Embodiment 1.

Figure 4:
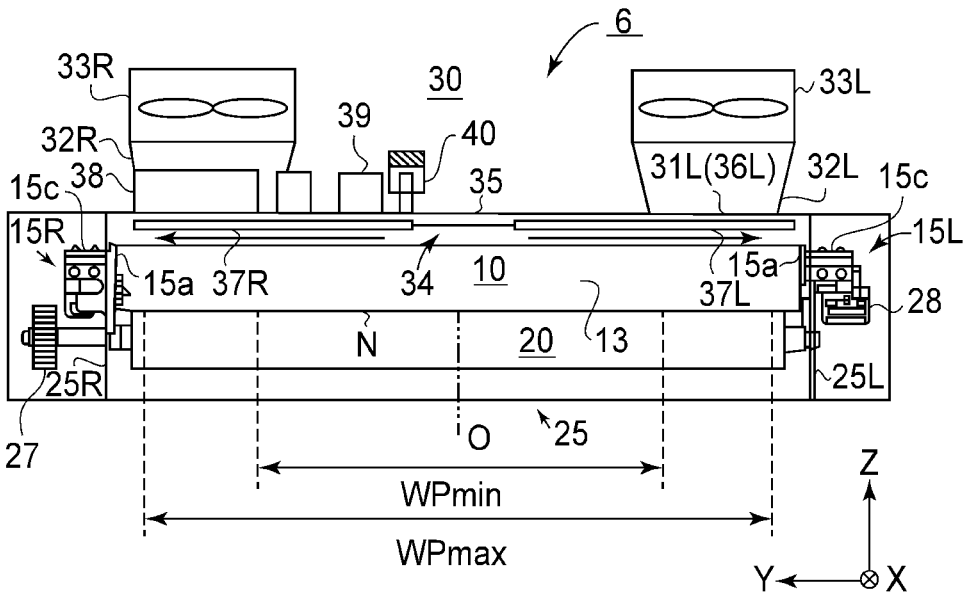
Figure 4:
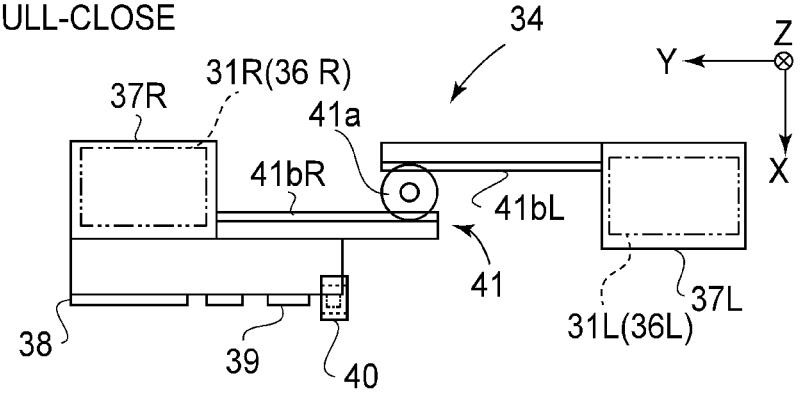

Part (a) of FIG. 4 is a schematic longitudinal rear surface view of the principal part of the fixing device (during full-close of shutters of a shutter mechanism in an air blowing cooling mechanism portion), and part (b) of FIG. 4 is a schematic top plan view of the shutter mechanism during full-close of the shutters.

Figure 5:
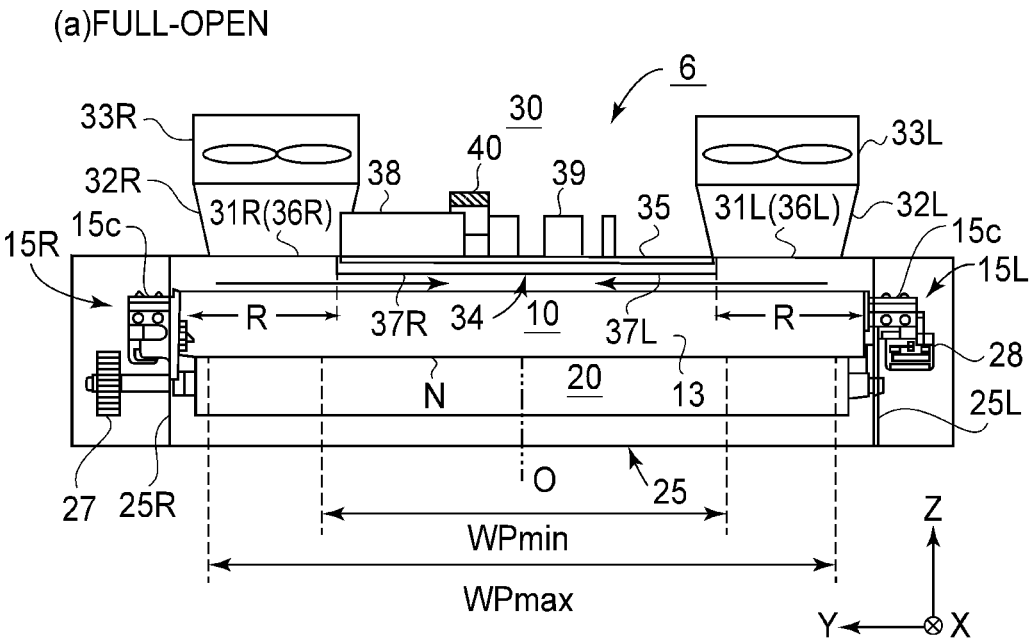
Figure 5:
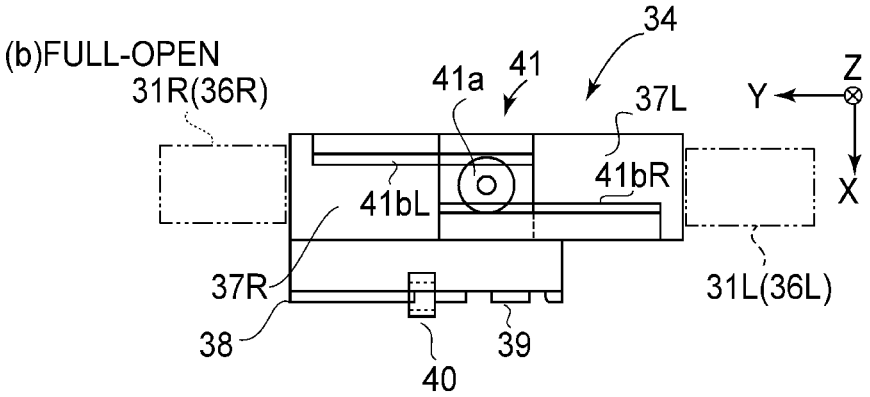

Part (a) of FIG. 5 is a schematic longitudinal rear surface view of the principal part of the fixing device (during full-open of shutters of a shutter mechanism in an air blowing cooling mechanism portion), and part (b) of FIG. 5 is a schematic top plan view of the shutter mechanism during full-open of the shutters.

Figure 6:
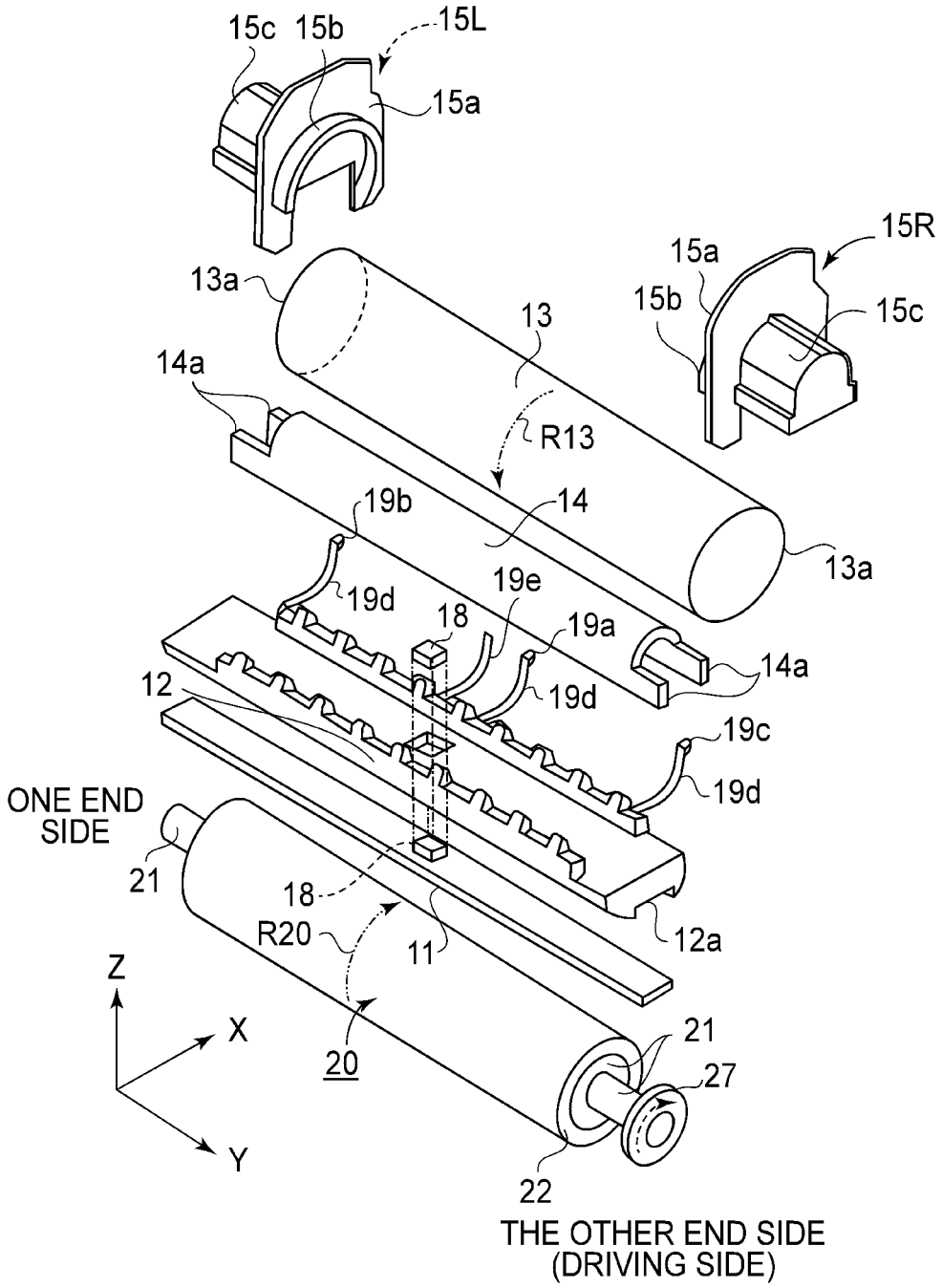

FIG. 6 is a schematic exploded perspective view of a fixing assembly.

Figure 7:
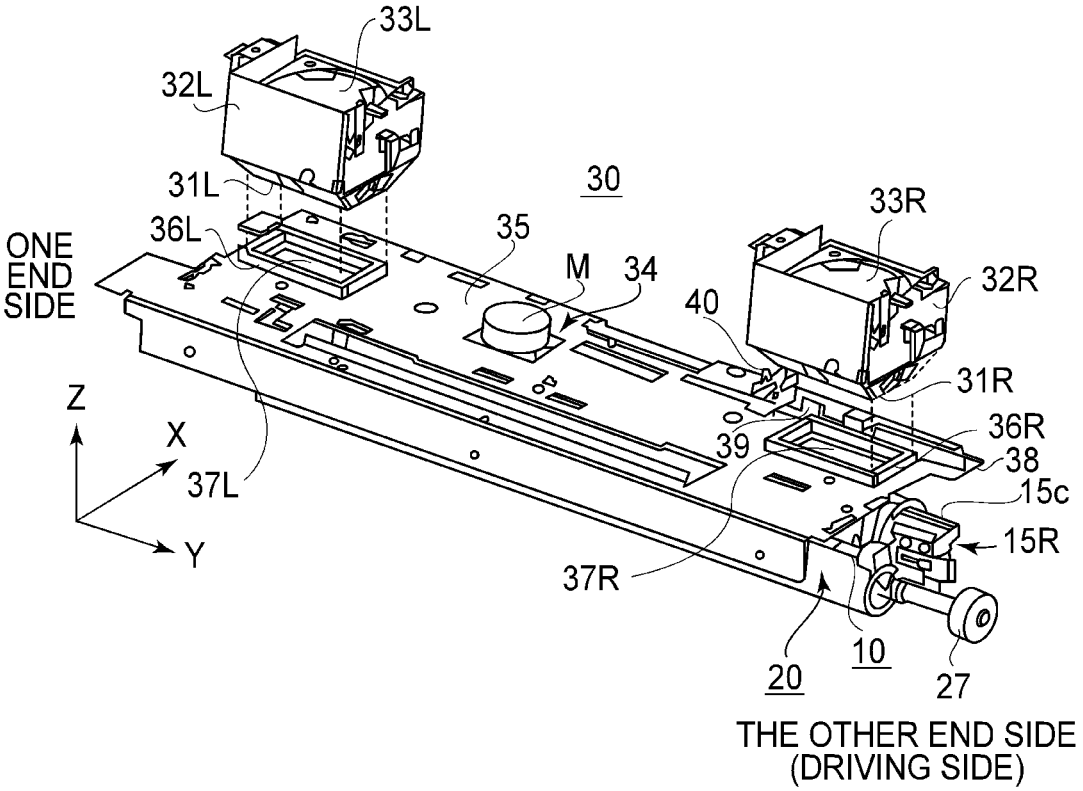

FIG. 7 is a schematic exploded perspective view of the air blowing cooling mechanism portion.

Figure 8:
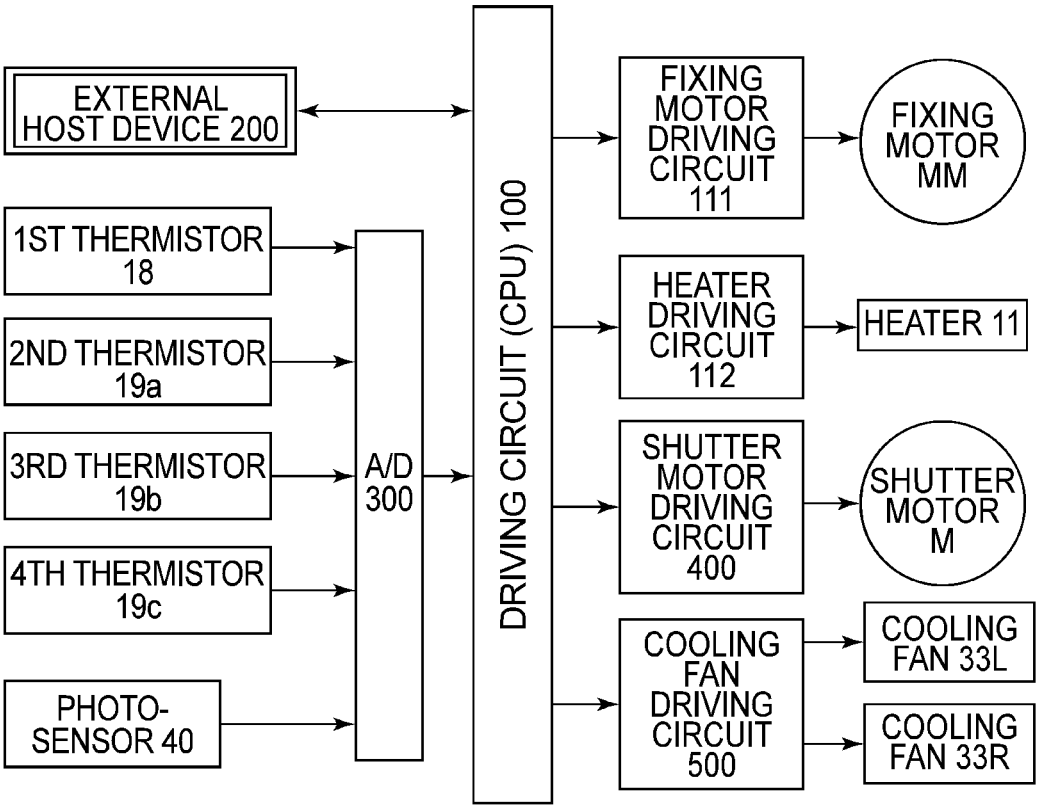

FIG. 8 is a block diagram of a control system.

Figure 9:
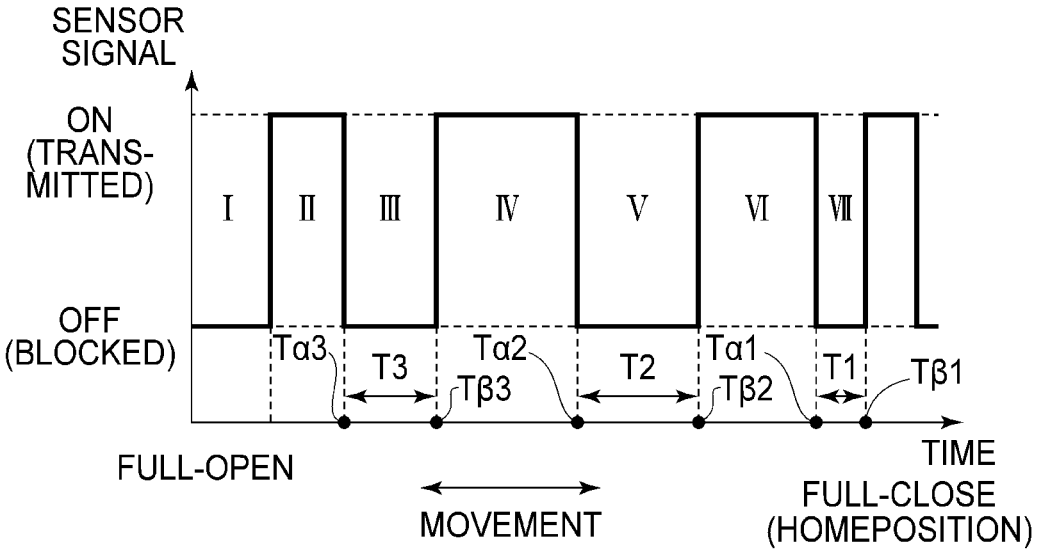

FIG. 9 is a diagram showing a switching time of an ON signal and an OFF signal which are outputted by a photosensor in Embodiment 1.

Figure 10:
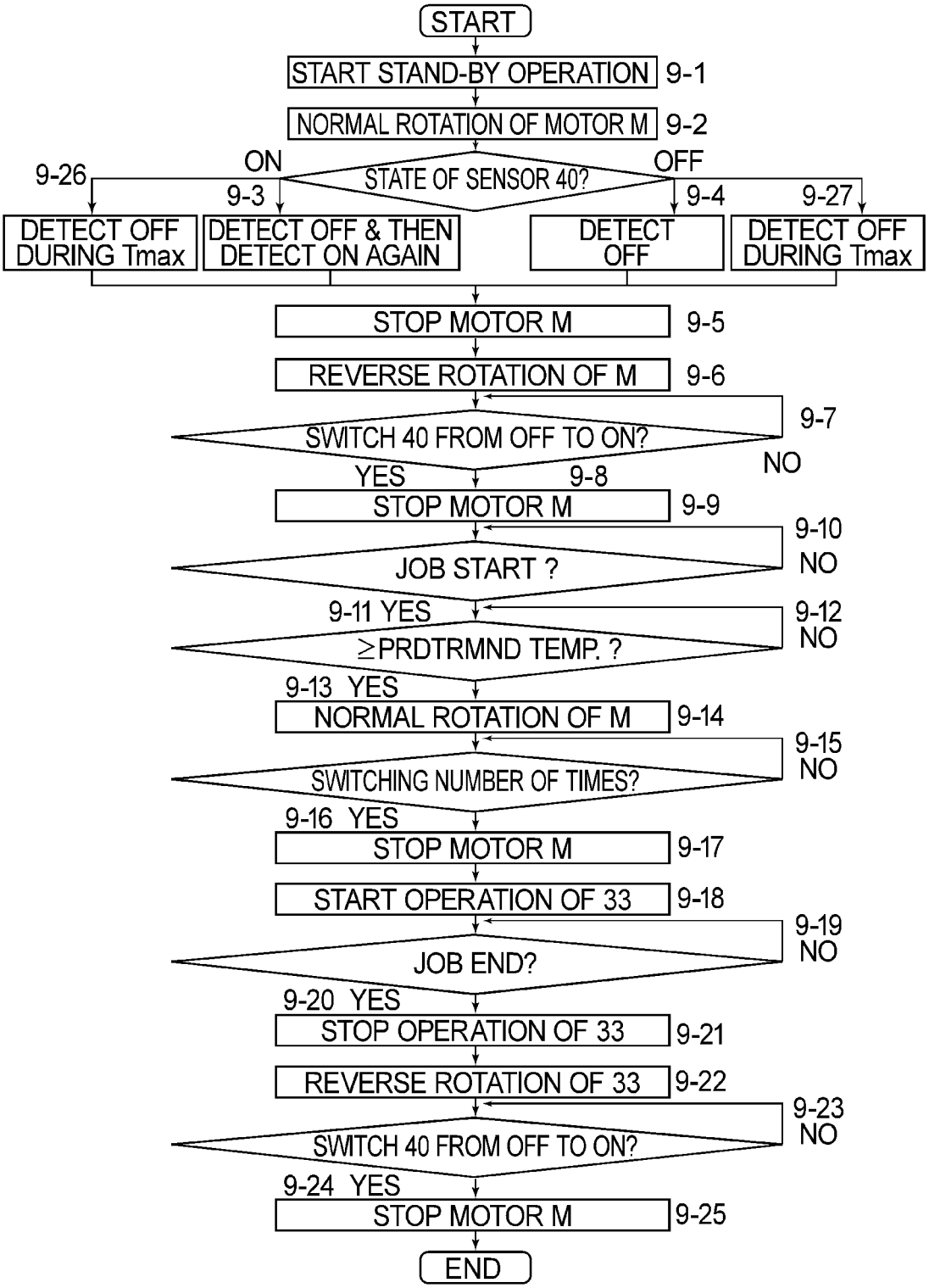

FIG. 10 is a flowchart of an opening and closing operation of shutters in Embodiment 1.

Figure 11:
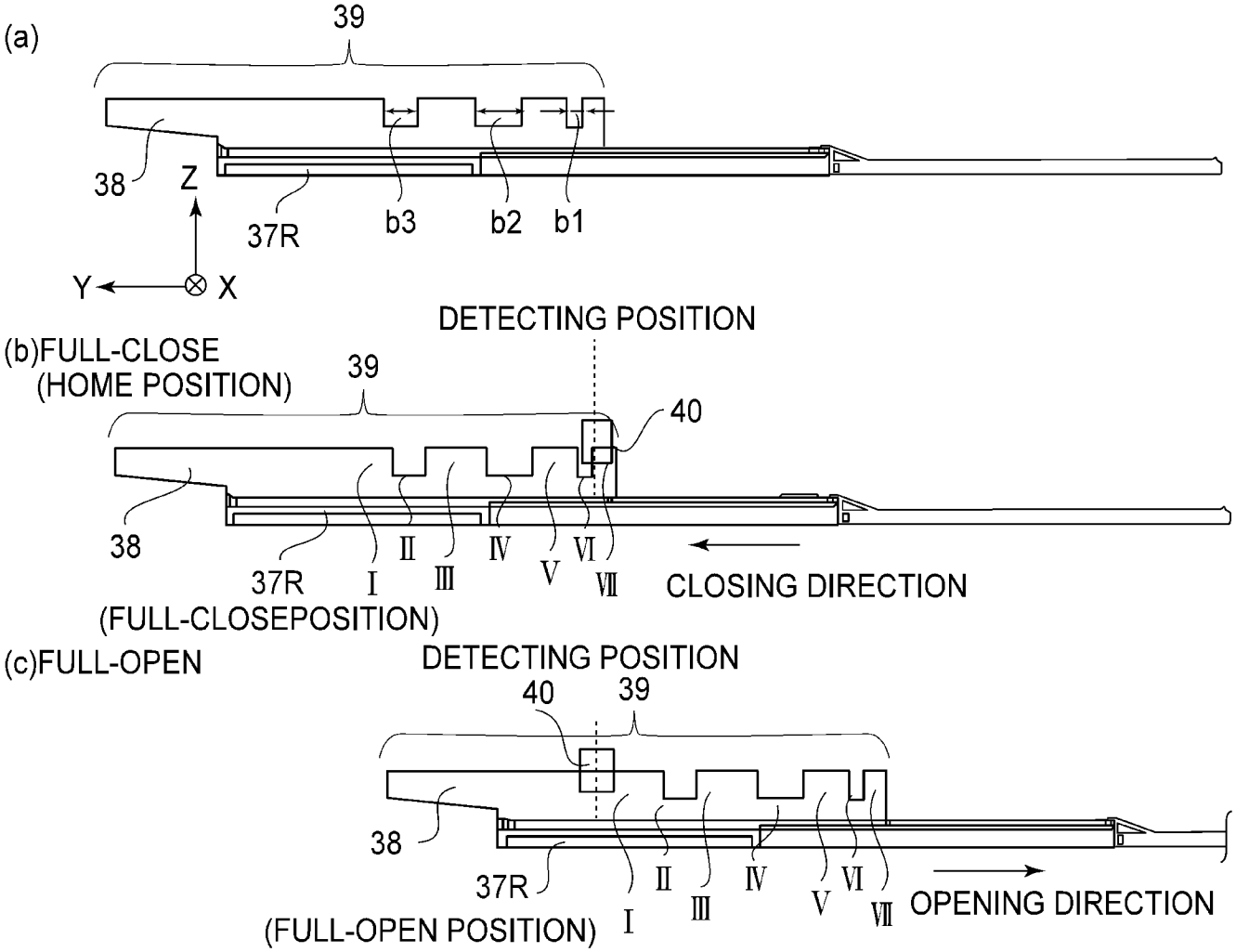

Parts (a), (b) and (c) of FIG. 11 are illustrations of a shutter position detecting means in an air blowing cooling mechanism in Embodiment 2.

Figure 12:
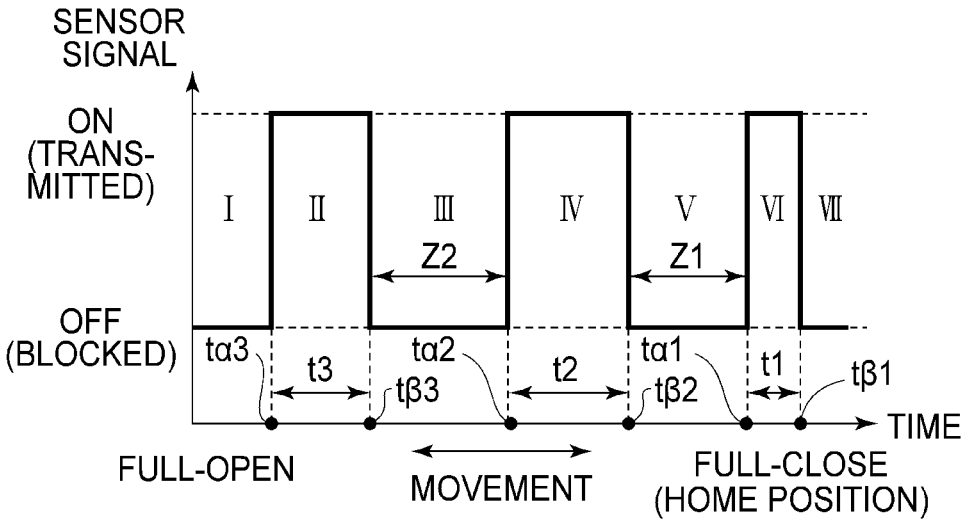

FIG. 12 is a diagram showing a switching time of an ON signal and an OFF signal which are outputted by a photosensor in Embodiment 2.

Figure 13:
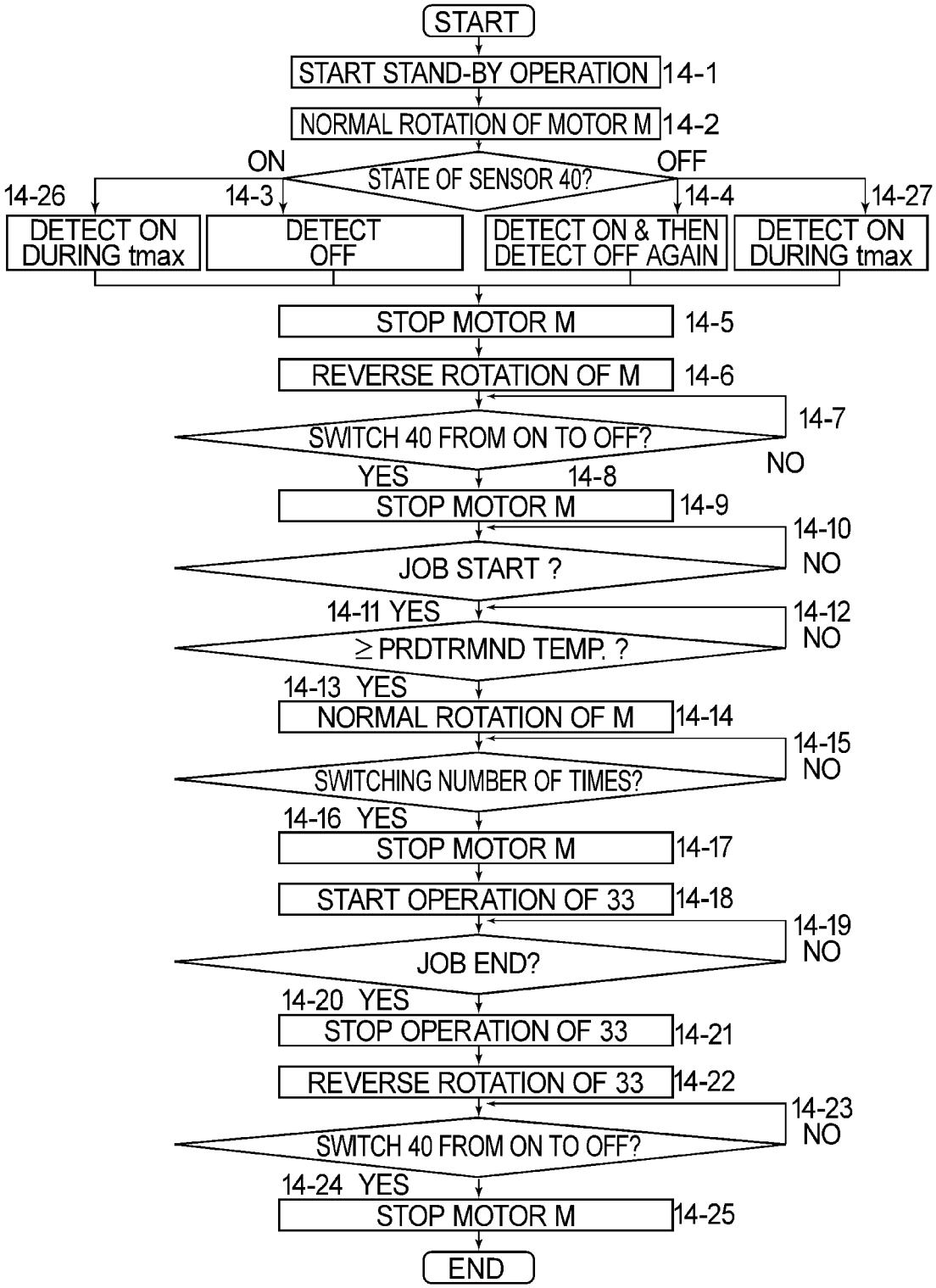

FIG. 13 is a flowchart of an opening and closing operation of shutters in Embodiment 2.

Figure 14:
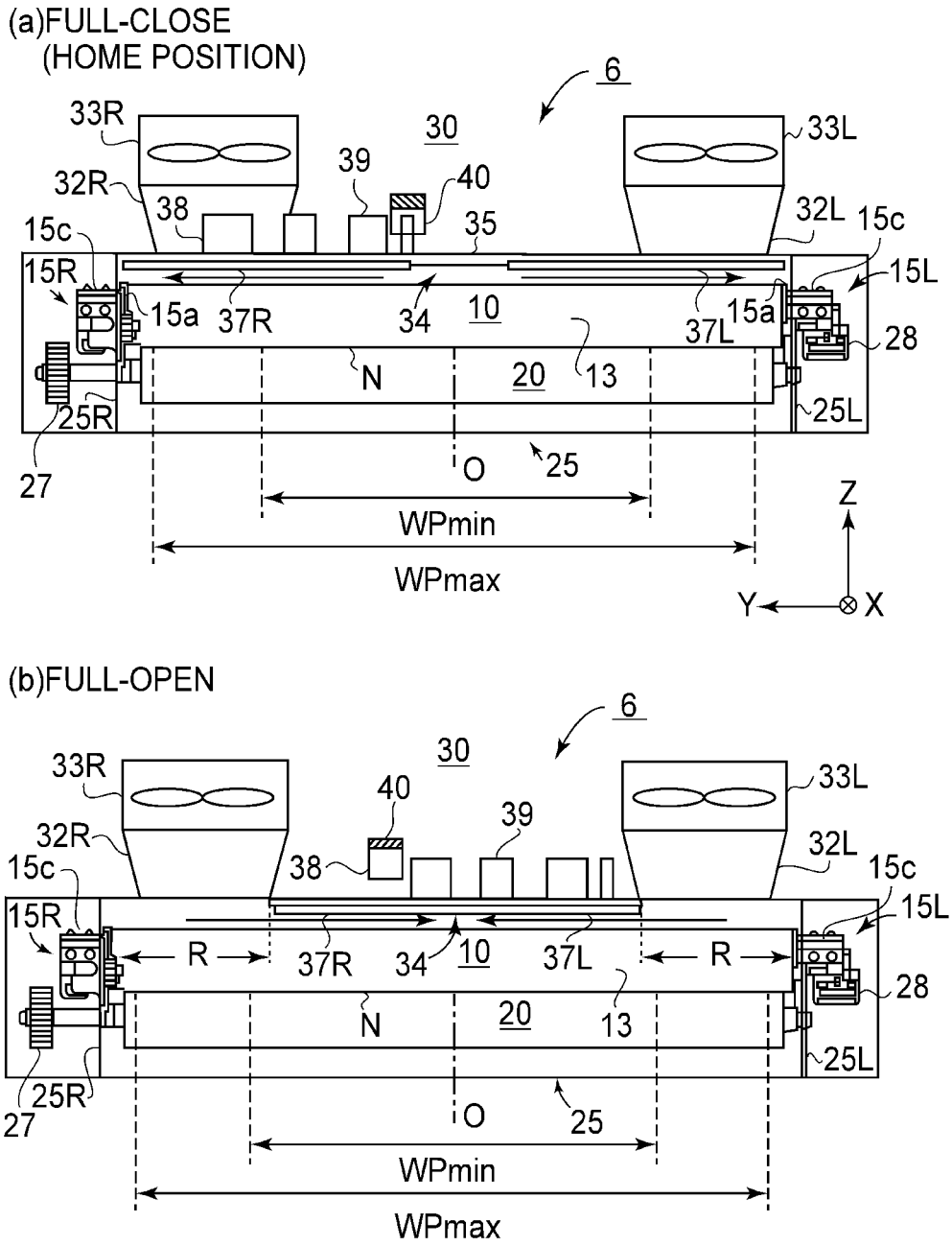

Part (a) of FIG. 14 is a schematic longitudinal rear surface view of the principal part of a fixing device in Embodiment 3 (during full-close of shutters of a shutter mechanism in an air blowing cooling mechanism portion), and part (b) of FIG. 14 is a schematic top plan view of the shutter mechanism during full-close of the shutters.

Figure 15:
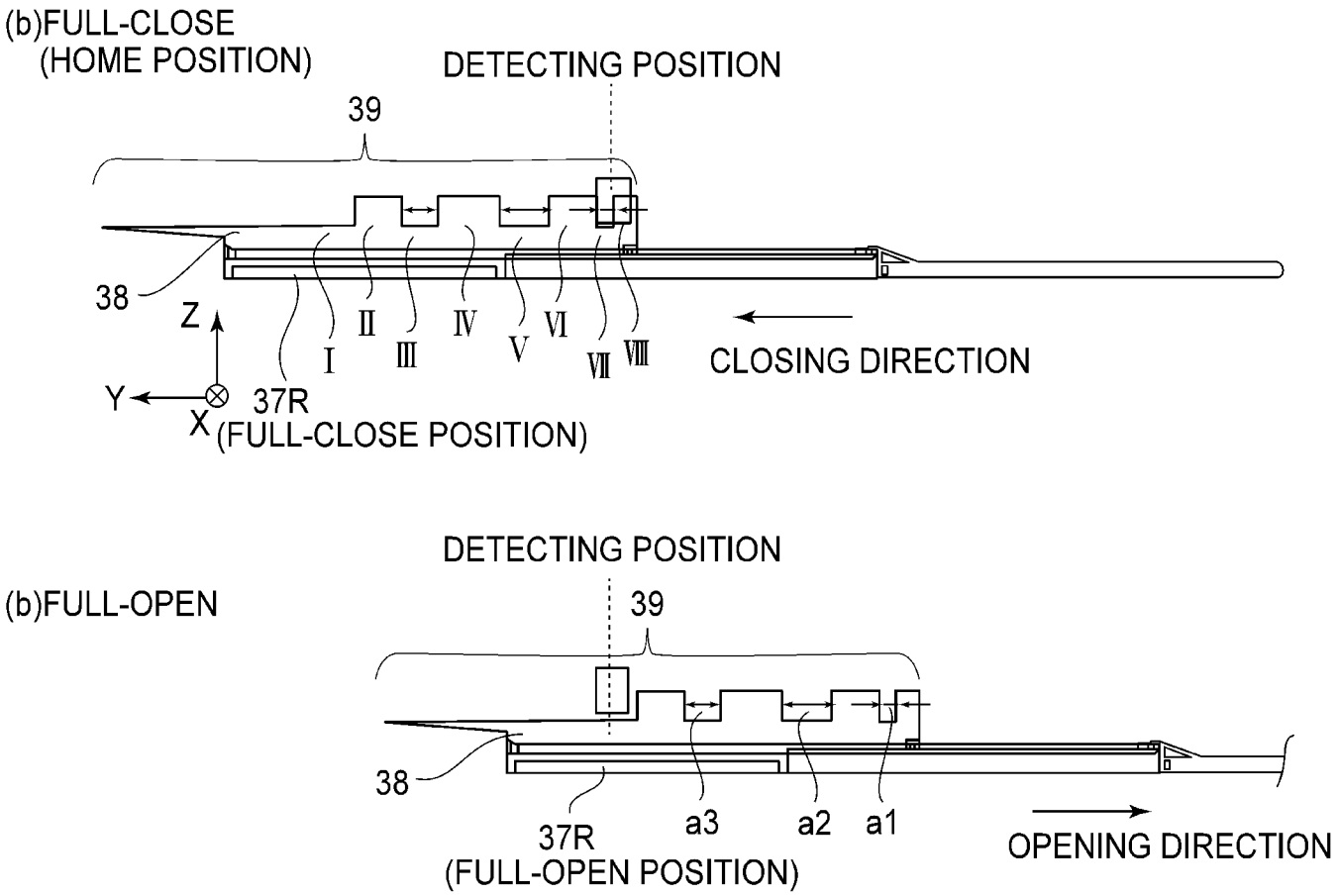

Parts (a) and (b) of FIG. 15 are illustrations of a shutter position detecting means in an air blowing cooling mechanism in Embodiment 3.

Figure 16:
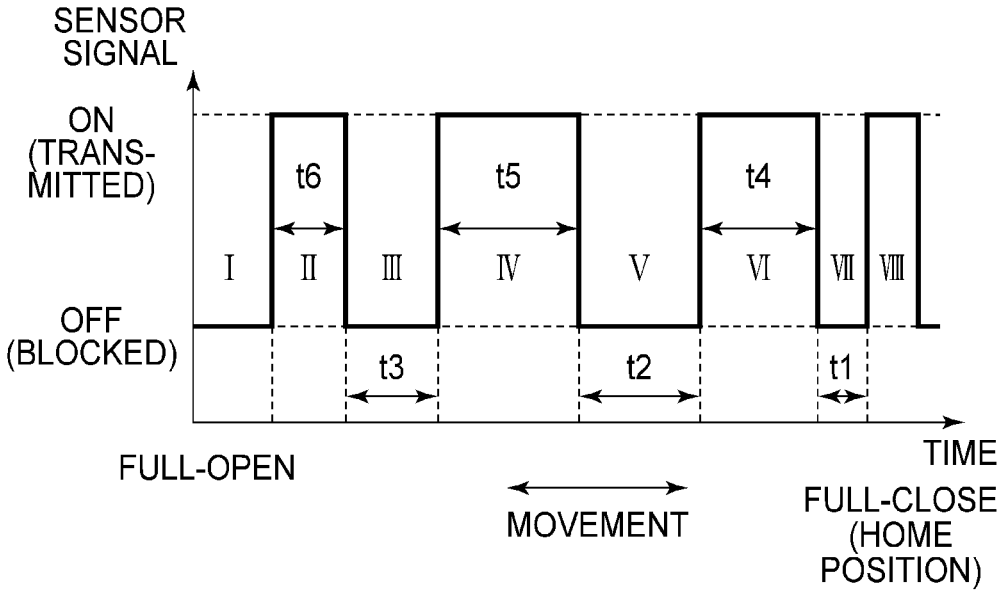

FIG. 16 is a diagram showing a switching time of an ON signal and an OFF signal which are outputted by a photosensor in Embodiment 3.

Figure 17:
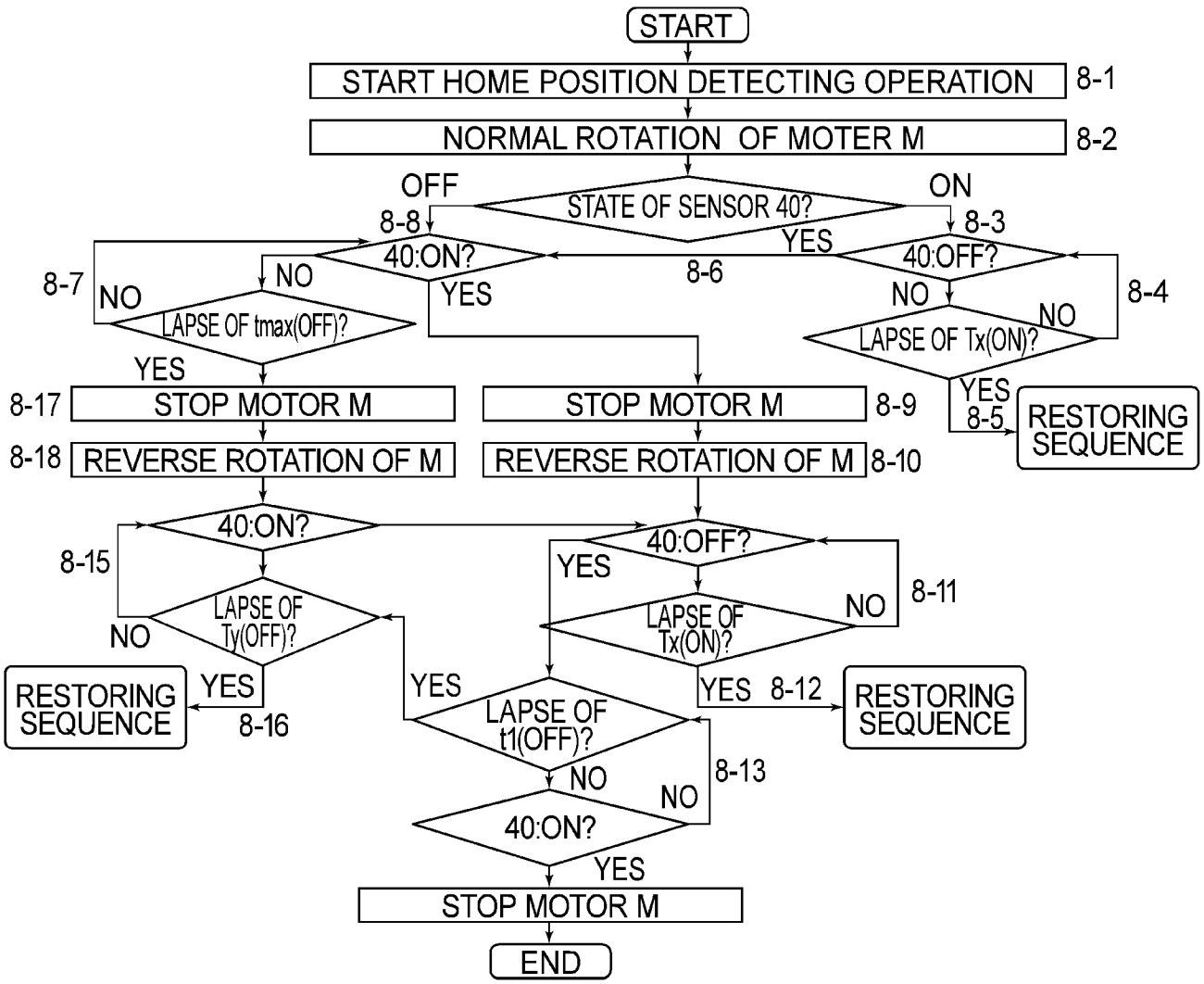

FIG. 17 is a flowchart of an opening and closing operation of shutters in Embodiment 3.

Figure 18:
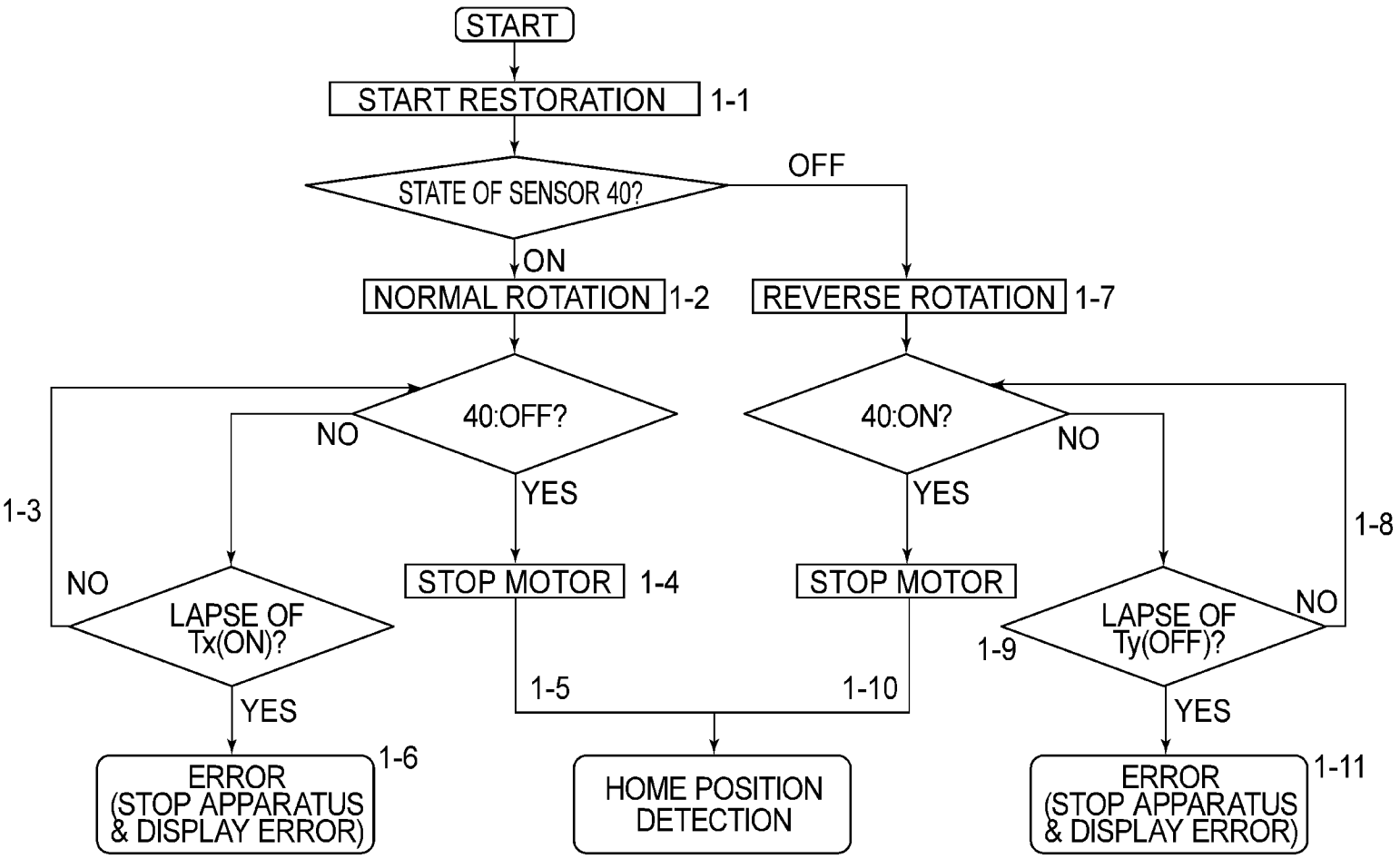

FIG. 18 is a flowchart of a restoring operation of the shutters in Embodiment 3.

Figure 19:
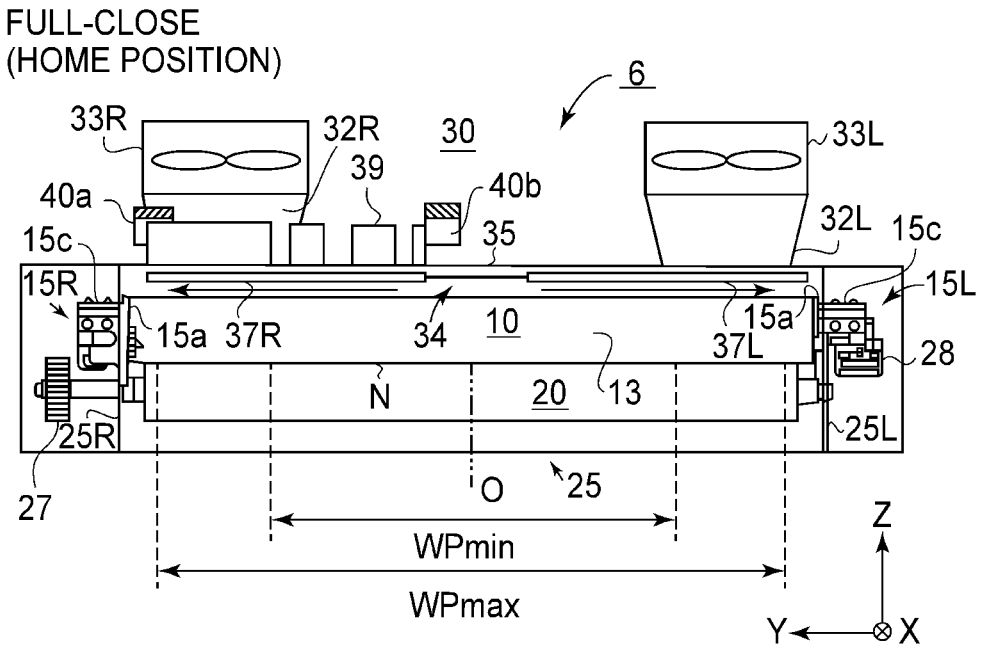

FIG. 19 is an illustration of Comparison Example 1.

Figure 20:
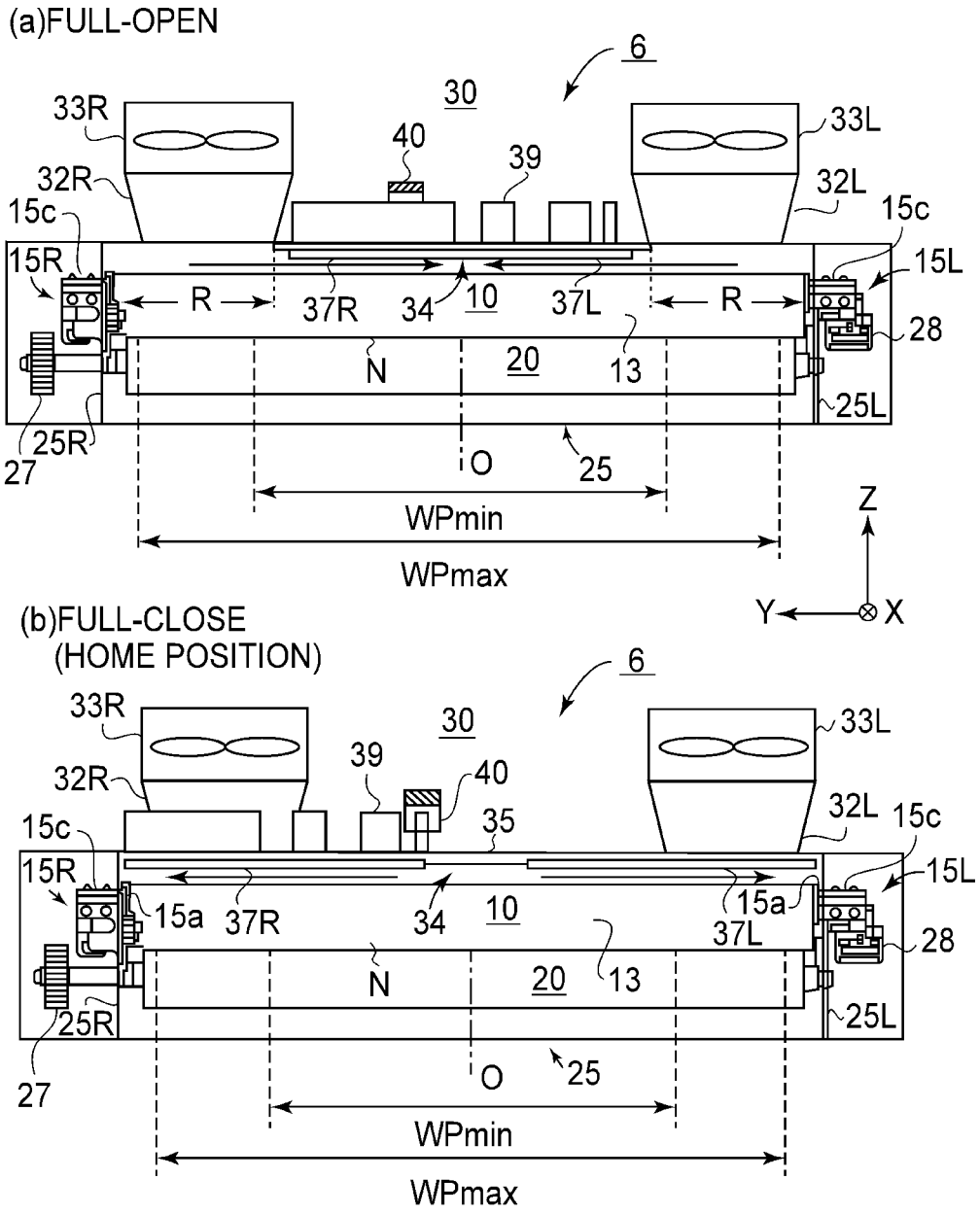

Parts (a) and (b) of FIG. 20 are illustrations of Comparison Example 3.

DESCRIPTION OF EMBODIMENTS

Embodiments for carrying out the present invention will be specifically described with reference to the drawings. Dimensions, materials, shapes and relative arrangements of constituent elements described in the following embodiments should be appropriately be changed depending on structures and various conditions of mechanisms (apparatuses) to which the present invention is applied, and the scope of the present invention is not intended to be limited to the following embodiments.

Embodiment 1

(Image Forming Apparatus)

Figure 2:
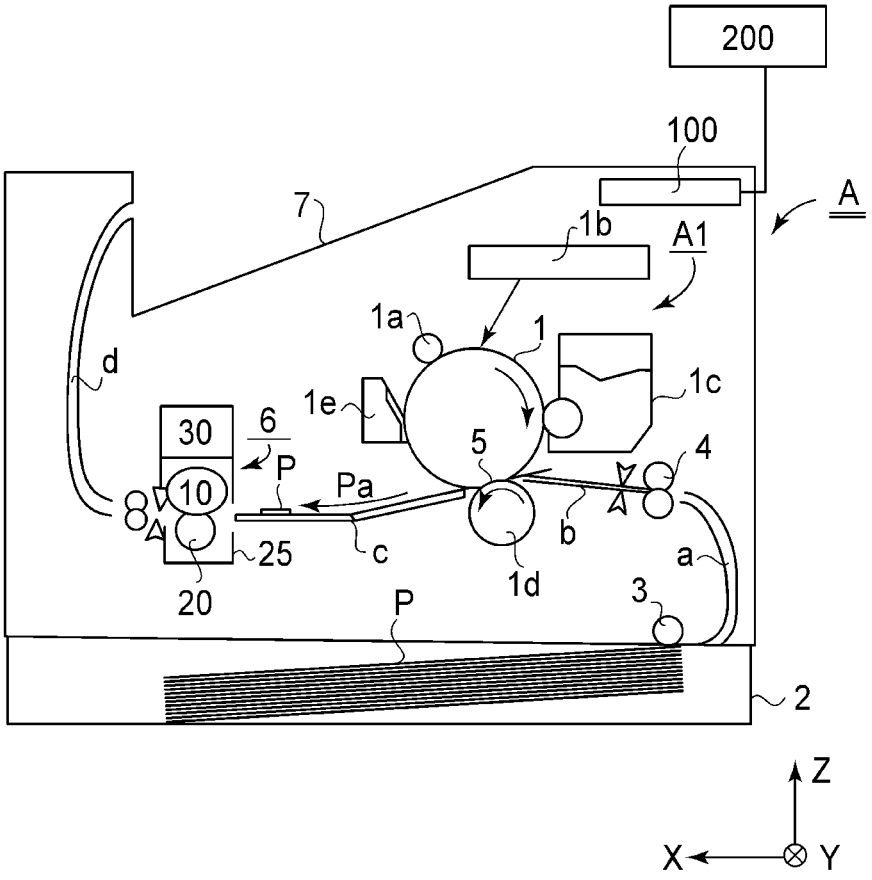
FIG. 2 is a schematic sectional view showing a general structure of an example of an image forming apparatus.

FIG. 2 is a schematic sectional view showing a general structure of an example of an image forming apparatus A using electrophotography, in which an image heating apparatus according to the present invention is mounted as a fixing device 6. In this embodiment, the image forming apparatus A is a monochromatic printer in which a toner image is formed on a recording material P by executing an image forming operation corresponding to an image forming job (print job). The print job may be inputted from an external host device 200, such as a personal computer, to a control circuit portion (CPU) 100 of the image forming apparatus A. The recording material on which the toner image was formed is printed out from the image forming apparatus A.

Incidentally, the recording material P is a sheet-shaped recording medium (media) on which the toner image is capable of being formed by the image forming apparatus A. For convenience, treatment of the recording material (sheet) P will be described using sheet (paper)-related terms such as sheet passing, sheet feeding, sheet discharge, sheet passing portion and non-sheet-passing portion, but the recording material is not limited to paper. Hereinafter, the recording material P is referred to as a sheet or paper.

In the image forming apparatus A, an image forming portion A1 for forming the toner image on the sheet P includes a drum-type electrophotographic photosensitive member (drum) 1 as an image bearing member. The drum 1 is rotationally driven at a predetermined peripheral speed in the clockwise direction indicated by an arrow. Further, at a periphery of the drum 1 along a drum rotational direction, the image forming portion A1 includes, process devices actable on the drum 1. The process devices include a charging roller 1*a*, a laser scanner 1*b*, a developing device 1*c*, a transfer roller 1*du*, and a cleaning device 1*e*. An electrophotographic process and an image forming operation of the image forming portion A1 are well known, and therefore will be omitted from description.

One sheet P of sheets P accommodated in a sheet cassette 2 is separated and fed at predetermined control timing by rotation of a feeding roller 3. The sheet P passes through a path including a feeding path a, a registration roller pair 4, and a feeding path b. After passing through the path, the sheet P is introduced at predetermined control timing to a transfer portion (transfer nip) 5, which is a contact portion between the drum 1 and the transfer roller 1*d*. The sheet P is successively subjected to transfer of the toner image formed on the surface of the drum 1 during a process of being nipped and fed at the transfer portion 5.

Figure 1:
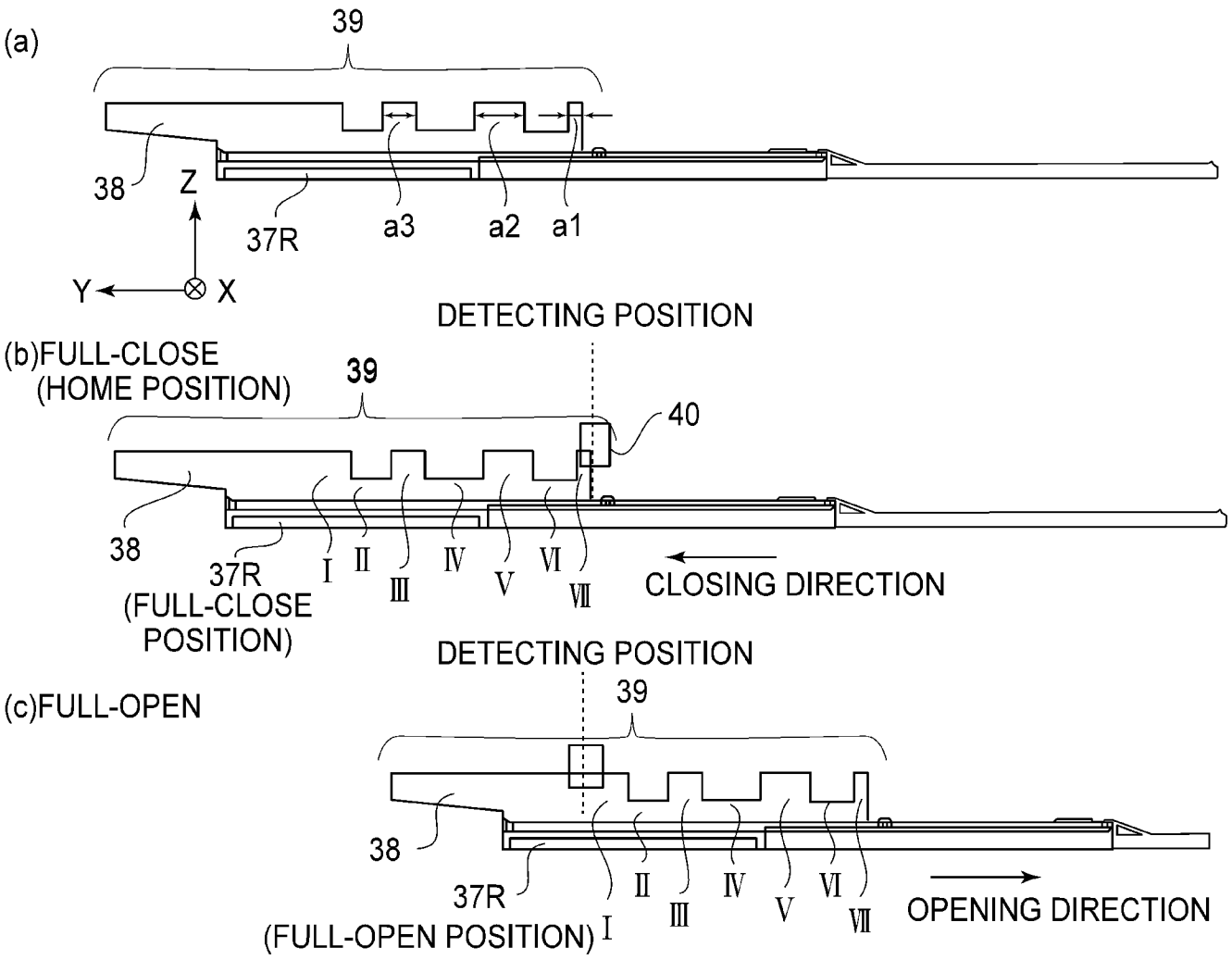

The sheet P coming out of the transfer portion 5 is separated from the surface of the drum 1 and passes through feeding path c and then is introduced into a fixing device (heating fixing device, image heating apparatus) 6 in which the toner image (image) formed on the sheet (recording material) P is fixed on the sheet S under application of heat and pressure. The sheet P coming out of the fixing device 6 passes through feeding path d and is discharged as the image-formed product (resulting product) onto a discharge tray 7. In FIG. 1, an arrow Pa direction is a sheet feeding direction.

(Fixing Device)

Here, with respect to the fixing device 6, a front surface (side) is a surface (side) on an introduction side of the sheet P, a rear surface (side) is a surface (side) opposite from the front surface (side), and left and right are left (L) and right (R) as seen from the front side. A longitudinal direction is an axial direction or a generatrix direction of a rotatable member, and a short side direction is a direction perpendicular to the longitudinal direction. Up (upper) and down (lower) are up (upper) and down (lower) with respect to a direction of gravitation. These are also true for constituent members of the fixing device 6.

Further, an upstream side and a downstream side are an upstream side and a downstream side with respect to the sheet feeding direction Pa. One end side and the other end side are one end side and the other end side with respect to the longitudinal direction. In this embodiment, a left side is one end side, which is also a non-driving side and a front side. A right side is the other end side, which is also a driving side, where a driving force is received, and a rear side. A width of the sheet P is a sheet dimension on a sheet surface with respect to a direction perpendicular to the sheet feeding direction Pa.

Figure 3:
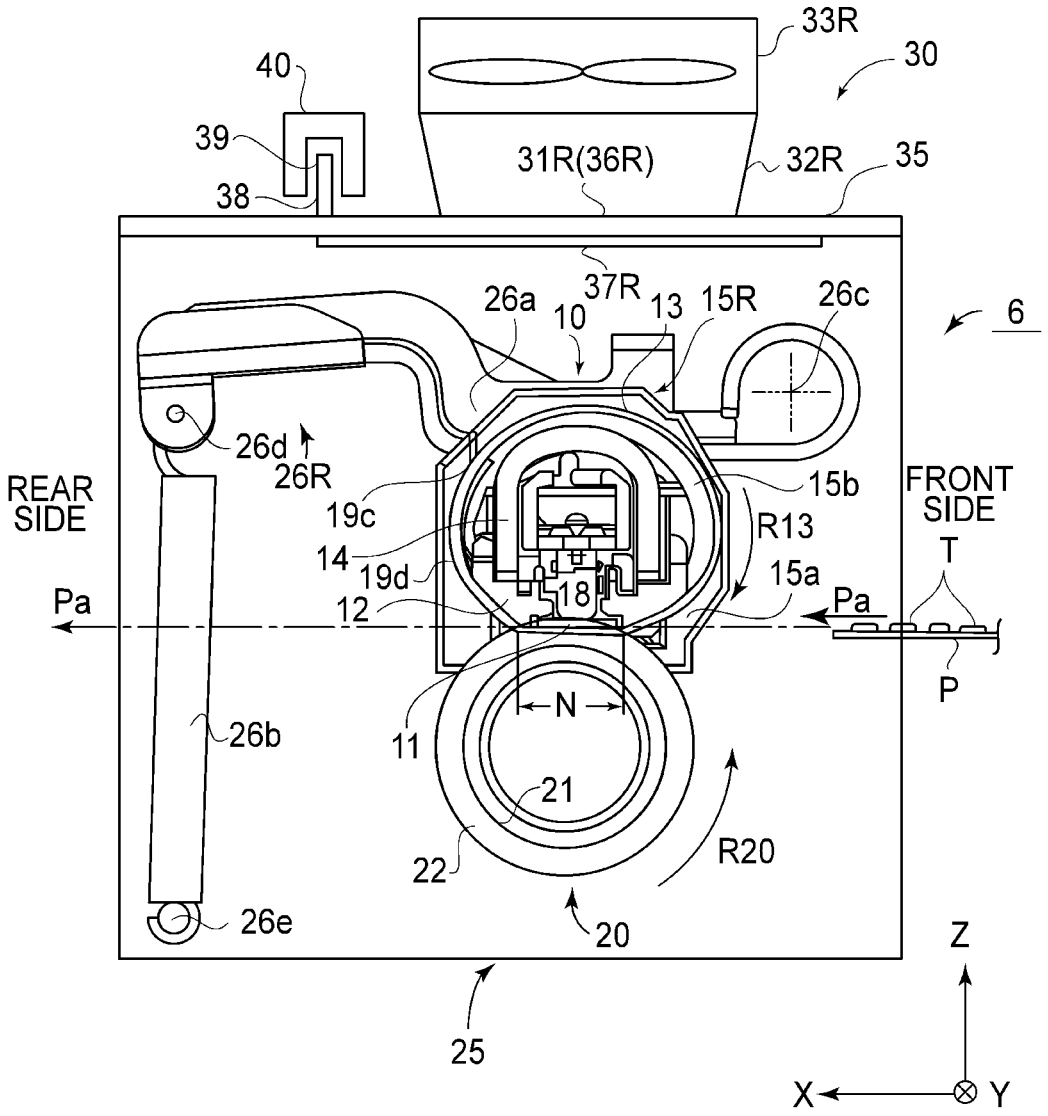
FIG. 3 is a schematic cross-sectional right-side view of a principal part of a fixing device.

FIG. 3 is a schematic cross-sectional right-side view of a principal part of the fixing device 6. Part (a) of FIG. 4 is a schematic longitudinal rear surface view of the principal part of the fixing device 6 and shows the time of full-close of shutters of a shutter mechanism 34 in an air blowing cooling mechanism portion 30. Part (b) of FIG. 4 is a schematic top plan view of the shutter mechanism 34 at the time of full-close of the shutters. Part (a) of FIG. 5 is a schematic longitudinal rear surface view of the principal part of the fixing device 6 and shows the time of full-open of shutters of the shutter mechanism 34 in the air blowing cooling mechanism portion 30. Part (b) of FIG. 5 is a schematic top plan view of the shutter mechanism 34 at the time of full-open of the shutters.

This fixing device 6 is an image heating apparatus of a film (belt) heating type. The fixing device 6 roughly includes a fixing assembly (fixing member) 10 provided with a fixing film (fixing belt) 13, a pressing roller (fixing member) 20 having elasticity, a (fixing) device frame (device casing) 25 accommodating these members 10 and 20, and an air blowing cooling mechanism 30. In the following, the fixing assembly 10 is similarly referred to as the assembly 10. A nip (fixing nip) N is formed by cooperation between the fixing film 13 (rotatable heating member: first rotatable member) and the pressing roller 20 (rotatable pressing member: second rotatable member) which are used as a pair of rotatable members).

The nip N is a portion where the sheet P, carrying thereon an unfixed toner image T, is nipped and fed, and thus the toner image T is fixed on the sheet P under application of heat and pressure. In the nip N, the fixing film (fixing belt) 13 contacts the surface of the sheet P on which the unfixed toner image T is carried.

Here, in this embodiment, the sheet P is fed to the fixing device 6 on a so-called center (centerline) feeding basis. Here, center (centerline) feeding refers to a method in which when sheets different in width size are fed, these sheets are fed so that centers (centerlines) of the respective sheets with respect to the widthwise direction (perpendicular to the recording material (sheet) feeding direction) of the sheets coincide with each other. In part (a) of FIG. 4 and part (a) of FIG. 5, "O" represents a reference line (center reference line, phantom line) as the center line in the center (centerline) feeding.

In FIG. 7, "WPmax" is a sheet passing region width of a maximum width sheet (for example, 330 mm in width) that can be used in the apparatus. "WPmin" is a sheet passing region width of a minimum width sheet (for example, 100 mm in width) that can be used in the apparatus. In the case where a sheet narrower in width than the maximum width sheet is fed using the center feeding basis, non-sheet-passing portions corresponding to a difference in width between the two sheets exist in the nip N and exist outside WPmin on both sides (one end side and the other end side).

[Assembly]

The assembly 10 is an assembly of a cylindrical (endless belt-shaped) fixing film 13, a heater 11, a heat-insulating holder 12, a pressing stay (metal stay) 14, fixing flanges 15 (L, R), and the like. FIG. 6 is an exploded perspective view of this assembly 10, and the pressing roller 20 is also illustrated together with the assembly 10.

(1) Fixing Film

The fixing film (fixing belt, flexible sleeve, hereinafter referred to as a film) 13 as the rotatable heating member is a thin endless heat transfer member having flexibility and a heat-resistant property. The film 13 assumes a substantially cylindrical shape in a free state thereof by its own elasticity.

The film 13 is a heat-resistant film of 200 μm or less in thickness. Such a thickness enables a quick start. A base layer of the film 13 is formed of a heat-resistant resin material such as polyimide, polyamideimide or PEEK (polyether ether ketone. The base layer may also be a pure metal having a heat-resistant property and a high heat transfer property, such as SUS (stainless steel), Al, Ni, Cu, Zn, or an alloy of these metals.

In the case of the base layer made of the resin material, a heat transfer powder of BN, alumina, Al or the like may also be mixed in the base layer in order to improve the heat transfer property. Further, a film 13 having sufficient strength and excellent in durability is preferred for the fixing device to have a long lifetime. Such a film 13 may have a total thickness of 100 μm or more. Therefore, a total thickness of 100 μm or more and 200 μm or less in may be an optimum total thickness of the film 13.

Further, in order to prevent offset and to ensure a separating property of the sheet P, a parting layer made of a heat-resistant resin material having a good parting property may be used as a surface layer of the film 13. The material having a good parting property includes fluorine-containing resin material such as PTFE, PFA, FEP, ETFE, CTFE or PVDF or a silicone resin material either singly or in mixture. The surface layer is formed and coated on the base layer. In this embodiment, the surface layer is constituted by a material at least containing PTFE and PFA.

Here, PTFE is polytetrafluoroethylene, PFA is a tetrafluoroethylene-perfluoroalkylvinyl ether copolymer, and FEP is a tetrafluoroethylene-hexafluoropropylene copolymer. Further, ETFE is an ethylenetetrafluoroethylene copolymer, CTFE is polychlorotrifluoroethylene, and PVDF is poly (vinylidene fluoride).

As a coating method, the parting layer may be coated on an outer surface of the film 13, after being subjected to etching, by dipping, powder spraying, or the like. Alternatively, the film may be coated with a resin material formed in a tube shape may also be employed. In another alternative, a method in which the outer surface of the film 13 is subjected to blasting, and thereafter, a primer layer of an adhesive is coated on the blasted surface of the film 13 may also be employed. Then, the parting layer is coated on the primer layer.

(2) Heater

The heater 11 is a ceramic heater, in this embodiment, and is an elongated plate-shaped heat generating element. A full-length portion of the heat generating element has an effective heat generating region width, which is abruptly increased in temperature by energization and which has low thermal capacity. In this heater 11, the heat generating element (heat generating resistor, an energization heat generating resistor layer) is formed by printing electroconductive paste of Ag—Pd or the like in a thick film (layer) on an elongated thin plate-shaped substrate (ceramic substrate) of AlN (aluminum nitride) having a good heat-transfer property.

A glass coating layer is provided integrally with the heat generating element, so that the ceramic heater is constituted. The glass coating layer is a slidable insulating member and has a thickness of about 50-60 m. In this embodiment, the glass coating layer side is a heater front surface side and the ceramic heater contacts an inner surface of the film 13 on this side.

The heat generating element is formed along the longitudinal direction of the substrate in a length corresponding to a width of a maximum-width size sheet usable in the fixing device or a length longer than the above length by a predetermined distance. The length of this heat generating element is the effective heat generating region width of the heater 11. In the heater 11, a chip-shaped thermistor (first thermistor) 18 is provided on the substrate (on the heater rear surface side) opposite from a side where the heat generating element is provided while sandwiching the substrate between itself and the heat generating element. This thermistor 18 is fixed to the substrate (heater rear surface) with predetermined pressure by a pressing means (not shown) such as a spring. The thermistor 18 is a temperature detecting element.

(3) Heating Insulating Holder

The heat insulating holder (heater holding member, hereinafter referred to as a holder) 12 is an elongated member extending along the longitudinal direction (widthwise direction) of the film 13 and is formed of a heat-resistant resin material such as a liquid crystal polymer, a phenolic resin, PPS or PEEK. The lower the thermal conductivity of the holder 12, the less heat of the heater 11 is taken, so that heat can be efficiently conducted to the film 13, and therefore, a filler such as a glass balloon or a silica balloon may also be incorporated in the resin layer of the holder 12. The heater 11 is engaged in and held by a groove 12*a* (FIG. 6) formed on a lower surface of the holder 12 along the longitudinal direction of the holder 12 in a state in which a front surface thereof faces the inner surface of the film 13. Further, the holder 12 also has a function of guiding rotation of the film 13.

(4) Pressing Stay

The pressing stay 14 is a rigid member which extends along the longitudinal direction of the film 13 and which receives a reaction force from the pressing roller 20. Preferably, the pressing stay may be formed of a material which is not readily flexed even under application of a high pressure. In this embodiment, the stay 14 is a metal stay and uses a molded member of SUS 304 having a U-shape in cross section. The stay 14 is provided on an upper surface side of the holder 12 and contacts the holder 12, so that flexure and twisting of an entirety of the assembly 10 are suppressed.

(5) Fixing Flanges

The film 13 is externally engaged (fitted) loosely with an assembly (assembled member) of the heater 11, the holder 12, and the stay 14. Both end portions 14*a* (FIG. 6) of the stay 14 project toward outsides of the film 13 through openings formed at both end portions of the film 13. Fixing flanges 15L and 15R on one end side and the other end side, respectively, are engaged with the associated end portions 14*a*, respectively, of the stay 14. The film 13 is positioned between opposing end portion regulating (preventing) surfaces (opposing collar seat portions) 15*a* of the engaged flanges 15L and 15R.

The flanges 15L and 15R are regulating (preventing) members for regulating (preventing) movement of the film 13 in the longitudinal direction and a shape of the film 13 with respect to a circumferential direction. The flanges 15L and 15R are molded products of a heat-resistant resin material such as PPS, the liquid crystal polymer, the phenolic resin, or the like. Each of the flanges 15L and 15R includes the end portion regulating surface 15*a*, an inner periphery regulating surface 15*b*, and a portion-to-be-pressed (pressure-receiving portion) 15*c*.

[Pressing Roller]

The pressing roller 20 is an elastic roller including a metal core 21 of SUS, SUM (sulfur and sulfur composite free-cutting steels), A1, or the like. The pressing roller 20 includes an elastic layer 22, formed outside the metal core 21. The elastic layer may be an elastic solid rubber layer, an elastic sponge rubber layer, or an elastic foam rubber layer, for example.

Here, the elastic solid rubber layer is formed of a heat-resistant rubber such as a silicone rubber or a fluorine-containing rubber. Further, the elastic sponge rubber layer is formed by foaming a silicone rubber in order to impart an heat-insulating effect. Further, the elastic foam rubber layer is formed by dispersing a hollow filler (microballoons or the like) in a silicone rubber layer, so that a hardened product is provided therein with a gas portion and thus the heat-insulating effect is enhanced. On these layers, a parting layer of a perfluoroalkoxy resin (PFA), polytetrafluoroethylene resin (PTFE) or the like may also be formed.

The pressing roller 20 is supported between side plates 25L and 25R on one end side and the other end side of the device frame 25 so as to be rotatable via bearings on one end side and the other end side of the metal core 21.

The assembly 10 is disposed between the side plates 25L and 25R in parallel to the pressing roller 20 so that the heater 11 side is opposed to an upper side of the pressing roller 20. The flanges 15L and 15R in the assembly 10 are engaged with guiding holes (not shown) extending in an up-down direction and formed symmetrically in the side plates 25L and 25R so that the portions-to-be-pressed 15*c* thereof are slidable (movable) in a direction toward the pressing roller 20.

[Pressing Mechanism]

The flanges 15L and 15R on one end side and the other end side receive predetermined pressing forces in the direction toward the pressing roller 20 at the portions-to-be-pressed 15*c* by pressing arms 26*a* of a pressing mechanism 26 on one end side and the other end side. Incidentally, in FIG. 3, a pressing mechanism 26R on the other end side is shown. A pressing mechanism 26L on one end side is not shown in FIG. 3. In part (a) of FIG. 4 and part (a) of FIG. 5, both the pressing mechanisms 26L and 26R on one end side and the other end side are omitted from illustration.

By the pressing forces, of the pressing mechanisms 26L and 26R on one end side and an entirety of the flanges 15L and 15R, the stay 14, the holder 12 and the heater 11 of the assembly 10 is pressed in the direction toward the pressing roller 20. For that reason, a part of the heater 11 and a part of the holder 12 are pressed toward the pressing roller 20 through the film 13 against elasticity of the elastic layer 22 by the predetermined pressing forces. As a result, the nip N with a predetermined width with respect to the sheet feeding direction Pa is formed between the film 13 and the pressing roller 20.

Outside the side plates 25L and 25R on one end side and the other end side of the device frame 25, the pressing mechanisms 26L and 26R on one end side and the other end side are provided, respectively. These pressing mechanisms 26L and 26R have a mirror symmetrical construction and have the same structure. Each of the pressing mechanisms 26L and 26R includes a pressing lever (arm) 26*a* and a pressing spring 26*b*. The lever 26*a* is mounted to the associated one of the side plates 25L and 25R on a base portion side thereof so as to be swingable about a shaft portion 26*c*. The lever 26*a* extends from the shaft portion 26*c* to a side opposite from the shaft portion 26*c* side via an upper side of the associated one of the portions-to-be-pressed 16*c* of the flanges 15L and 15R.

The spring 26*b* is an elastic member for rotationally urging the lever 26*a* about the shaft portion 26*c* in a pressing (urging) direction by bringing the lever 26*a* into contact with the associated one of the portions-to-be-pressed 15*c* of the flanges 15L and 15R. In this embodiment, the spring 26*b* is stretched between a free end portion 26*d* and a pin shaft 26*e* implanted in the associated one of the side plates 225L and 25R. Accordingly, the lever 26*a* contacts the associated one of the portions-to-be-pressed 15*c* of the flanges 15L and 15R by a tensile force of the spring 26 and imparts the predetermined pressing force to the associated portion-to-be-pressed 15*c*.

The lever 26*a* is rotatably supported relative to the associated one of the side plates 25L and 25R, so that the tensile force of the spring 26*b* generates a rotational moment about the shaft portion 26*c*, and thus, the associated one of the flanges 15L and 15R is pressed in the direction toward the pressing roller 20 by the pressing force.

[Fixing Operation]

On the other end side (driving side) of the metal core 21 of the pressing roller 20, a driving gear 27 is provided concentrically and integrally with the metal core 21. To this gear 27, a driving force of a fixing motor (driving source) MM is transmitted through a drive transmitting mechanism (not shown). The fixing motor MM is driven by a fixing motor driving circuit 111 which is controlled by the control circuit portion (controller) 100 (FIG. 8). As a result, the pressing roller 20 is rotationally driven as a rotatable driving member at a predetermined speed in the counterclockwise direction of an arrow R20 shown in FIG. 3.

By rotationally driving the pressing roller 20, rotational torque acts on the film 13 in the nip N by a frictional force between the film 13 and the pressing roller 20. The pressing roller 20 functions as a rotatable driving member for rotating the film 13. The film 13 is rotated by the pressing roller 20. As a result, the film 13 is rotated around the assembly of the heater 11, the holder 12 and the stay 14 in the clockwise direction of an arrow R13 shown in FIG. 3, while an inner surface of the film 13 slides on the part of the heater 11 and the part of the holder 12 in the nip N in close contact with the part of the heater 11 and the part of the holder 12. A rotational peripheral speed of the film 13 substantially corresponds to a rotational peripheral speed of the pressing roller 20.

The end portion regulating (preventing) surfaces 15*a* of the flanges 15L and 15R contact end surfaces (edge surfaces) 13*a* (FIG. 6) of the rotating film 13 and thus prevent movement of the film 13 in the longitudinal direction (thrust direction) of the film 13. The inner periphery regulating surfaces 15*b* are guiding surfaces for supporting an inner peripheral surface of the film 13 at end portions of the film 13. The inner periphery regulating surfaces 15*b* support the film 13 from an inside of the film 13 and are provided as arcuately projected edge portions that project toward the inner surface side of the flanges 15L and 15R. Between the film 13 and the heater 11, a lubricant, such as heat-resistant grease of a fluorine-containing type, a silicone type, or the like, is interposed, whereby a friction resistance is suppressed to a low level and thus the film 13 is smoothly rotatable (movable).

The control circuit portion 100 controls a heater driving circuit portion 112 and thus starts energization to the heater 11. Although an energization path from the heater driving circuit portion 112 toward the heater 11 is omitted from illustration, the energization is carried out via wiring electrically connecting the heater driving circuit portion 112 with the heater 11 and a connector 28 (part (a) of FIG. 4 and part (a) of FIG. 5). By this energization, a full-length region of the effective heat generating region of the heater 11 abruptly increases in temperature.

A temperature of the heater 11 is detected by the first thermistor 18 provided on the rear surface of the heater 11, so that detection temperature information is inputted to the control circuit portion 100 through an A/D converter 300. Further, inner surface temperatures of the film 13 rotating while being heated by the heater 11 are detected by second, third and fourth thermistors 19*a*, 19*b* and 19*c* (FIGS. 3 and 6), so that pieces of detection temperature information are inputted to the control circuit portion 100 through the A/D converter 300.

The control circuit portion 100 determines and appropriately controls a duty ratio, wave number and the like of a voltage applied from the heater driving circuit portion 112 to the heater 11, depending on the pieces of the detection temperature information (outputs) inputted from the first to fourth thermistors 18, 19*a*, 19*b* and 19*c*. As a result, the temperature in the nip N is increased to a predetermined fixing set temperature, so that temperature control is carried out.

In the above state of the fixing device 6, the sheet P on which the unfixed toner image T is formed is introduced from the image forming portion A1 into the fixing device 6 through an introducing port on the front side of the device frame 25 and is nipped and fed through the nip N. To the sheet P, heat of the heater 11 is imparted through the film 13 in a process in which the sheet P is nipped and fed through the nip N. The unfixed toner image T is melted by the heat of the heater 11 and is fixed as a fixed image on the sheet P by heat and pressure applied to the nip N. Then, the sheet P coming out of the nip N is discharged to an outside of the fixing device 6 through a discharging port of the device frame 25.

Incidentally, inside the device frame 25, a sheet guiding member, a sheet sensor, and the like are provided between the introducing port and the nip N, and a sheet guiding member, a discharging roller pair, a sheet sensor, and the like are provided between the nip N and the discharging port 25*c*, but these members are omitted from the figures.

The first thermistor 18 is disposed in contact with the rear surface of the heater 11 at a heater rear surface position substantially corresponding to the center reference line O. The second thermistor 19*a* detects the film temperature in contact with the inner surface of the film 13 at a position which is downstream of the nip N with respect to the film rotational direction and which substantially corresponds to the center reference line O. The third and fourth thermistors 19*b* and 19*c* detect the film temperature in contact with the inner surface of the film 13 at positions which are downstream of the nip N with respect to the film rotational direction and which substantially correspond to inside positions of ends of the sheet passing region width WPmax on one end side and the other end side, respectively.

That is, the second thermistor 19*a* detects a temperature of a film portion corresponding to a portion within the sheet passing region width WPmax which is a sheet passing portion common to any sheets having large and small (various) sizes usable in the apparatus. The third and fourth thermistors 19*b* and 19*c* are sub-thermistors each detecting a temperature of a film portion corresponding to the non-sheet-passing portion when a sheet narrower in width than the maximum width sheet is passed through the nip N.

The second to fourth thermistors 19*a*, 19*b* and 19*c* are supported at free end portions of elongated spring members 19*d*, respectively (FIG. 6). Base portions of the spring members 19*d* are fixed to the holder 12. That is, the second to fourth thermistors 19*a*, 19*b* and 19*c* are supported by the spring members 19*d*, respectively, so as to elastically contact and slide with the inner surface of the film 13. Further, the second to fourth thermistors 19*a*, 19*b* and 19*c* are mounted so that in a free state, free ends thereof project with a spring property to an outside of a projection shape of the film 13 during mounting of the film 13.

Further, the stay 14 made of metal is provided with a grounding member 19*e* (FIG. 6) contacting the inner surface of the film 13 in the neighborhood of the second thermistor 19*a* for the purpose of establishing the grounding of the film 13. The grounding member 19*e* is an elongated spring member in which a base portion is electrically connected to the stay 14 and a free end portion slides with the inner surface of the film 13 in elastic contact with the film inner surface. This grounding member 19*e* is also mounted similarly as in the case of the second to fourth thermistors 19*a*, 19*b* and 19*c* so that in a free state, a free end thereof projects with a spring property to the outside of the projection shape of the film 13 during the mounting of the film 13.

[Air Blowing Cooling Mechanism]

The air blowing cooling mechanism 30 will be described. The air blowing cooling mechanism 30 is a cooling means for preventing the non-sheet-passing portion temperature rise of the assembly 10 occurring when sheets narrower in width than the maximum width sheet usable in the apparatus are continuously passed through the nip N. FIG. 7 is an exploded perspective view of this air blowing cooling mechanism 30. FIGS. 4 and 5 illustrate the operation of the shutter mechanism 34 in the air blowing cooling mechanism 30.

The air blowing cooling mechanism 30 includes a left-side duct 32L provided with an air blowing opening 31L formed so as to oppose a portion on one end side (left end portion side) of the film 13 in the assembly 10 and includes a left-side cooling fan 33L (air blowing fan) for blowing cooling air into the duct 32L. Further, the air blowing cooling mechanism 30 includes a right-side duct 32R provided with an air blowing opening 31R formed so as to oppose a portion on the other end side (right end portion side) of the film 13 and includes a right-side cooling fan 33R for blowing cooling air into the duct 32R. Further, the air blowing cooling mechanism 30 includes a shutter mechanism 34 as an opening width adjusting mechanism for adjusting opening widths of the air blowing opening 31L of the left-side duct 32L and the air blowing opening 31R of the right-side duct 32R.

The shutter mechanism 34 includes a shutter frame 35, left and right window holes 36L and 36R provided in a portion on one end side (left end portion side) and a portion on the other end side (right end portion side), respectively, of the frame 35, and a pair of left and right movable shutters (shutter members) 37L and 37R. Further, the shutter mechanism 34 includes a shutter motor (pulse motor) M and a single photo-sensor 40 constituting a detecting means of a shutter position.

A shape and a size of the left and right window holes 36L and 36R correspond to a shape and a size of the air blowing openings 31L and 31R of the left and right ducts 32L and 32R, respectively. The left and right ducts 32L and 32R are fixedly provided to the shutter frame 35 so that the air blowing openings 31L and 31R are aligned and fitted with the left and right window holes 36L and 36R of the shutter frame 35.

The pair of left and right shutters 37L and 37R is provided on a surface (back surface side of the shutter frame 35) on a side opposite from a side of the shutter frame 35 where the ducts 32L and 32R are fixedly provided. The left-side shutter 37L moves so as to adjust an opening width of the left-side window hole 36L, i.e., the air blowing opening 31L of the left-side duct 32L. The right-side shutter 37R moves so as to adjust an opening width of the right-side window hole 36R, i.e., the air blowing opening 31R of the right-side duct 32R.

The left and right shutters 37L and 37R are connected with each other by a rack-pinion mechanism 41 (moving mechanism for moving the shutters: part (b) of FIG. 4 and part (b) of FIG. 5). The rack-pinion mechanism 41 includes a pinion 41*a* and racks 41*b*L and 41*b*R. The pinion 41*a* is rotationally driven normally and reversely by the shutter motor M. The shutter motor M is driven by a shutter motor driving circuit 400 controlled by the control circuit portion 100. As a result, the left and right shutters 37L and 37R move integrally with each other so as to similarly adjust the opening widths of the air blowing openings of the left and right ducts 32L and 32R.

In this embodiment, the left and right shutters 37L and 37R are moved at a predetermined speed in an open direction integrally with each other by driving the shutter motor M normally at a predetermined driving speed. Further, the left and right shutters 37L and 37R are moved at a predetermined speed in a close direction integrally with each other by driving the shutter motor M reversely at a predetermined driving speed.

The rack-pinion mechanism 41 moves the shutters 37L and 37R so as to be movable between a closed position, where the air blowing openings 31L and 31R are closed, and an open position. The shutter permit adjustment of the opening widths of the air blowing openings 31L and 31R to predetermined widths corresponding to a widthwise length of the sheet guided into the fixing device in the open position.

In order to avoid complexity, the only component parts of the air blowing cooling mechanism (portion) 30 shown in part (a) of FIG. 4 and part (a) of FIG. 5 shown are the ducts 32L and 32R, the cooling fans 33L and 33R and the shutters 37L and 37R.

The left and right shutters 37L and 37R are controlled so as to be moved to positions corresponding to the width of the sheet passed through the fixing device. As a result, widths of the air blowing openings 31L and 31R of the left and right ducts 32L and 32R are adjusted to optimum opening widths corresponding to the passed sheet width, so that air blowing cooling is carried out in ranges in which non-sheet-passing region temperature rise of the film 13 occurs.

As described above, as regards the fixing device 6 in this embodiment, feeding of the sheet P is carried out by center (centerline) basis feeding. For that reason, two air blowing openings 41L and 41R are disposed symmetrically with respect to a reference line O of the center basis feeding. Further, at the air blowing openings 41L and 41R, the shutters 37L and 37R are provided, respectively.

(1) Shutter Opening and Closing Operation

A shutter opening and closing operation will be described. At a bent edge portion 38 of the shutter 37R which is one of the left and right shutters 37L and 37R with respect to a longitudinal direction of the shutter 37R, a plurality of sensor flags 39 determined correspondingly to sheets having various width sizes are provided along a longitudinal direction of the bent edge portion 38 (the widthwise direction of the film). Further, a photo-sensor 40 for detecting an edge portion of the sensor flags 39 is provided by being fixed to the shutter frame 35 as a stationary member. The photo-sensor 40 outputs an ON signal and an OFF signal by light blocking and light transmission of an optical path of the sensor with movement of the sensor flags 39 moving together with the shutter 37R.

In this embodiment, the ON signal of the photo-sensor 40 is an output signal of a state (light transmitted state) in which the sensor optical path of the photo-sensor 40 is not blocked by the sensor flag 39. The OFF signal is an output signal of a state (light blocked state) in which the sensor optical path of the photo-sensor 40 is blocked by the sensor flag 39. The ON signal and the OFF signal are edge portion detection information of the sensor flag 39 by the photo-sensor 40. This edge portion detection information is inputted to the control circuit portion 100 through an A/D converter 300. Incidentally, in the following, the ON signal and the OFF signal are simply referred to as "ON" and "OFF", respectively, in some instances.

The control circuit portion 100 subjects the shutter motor M to normal rotation control or reverse rotation control so that the edge portion of the sensor flag 39 corresponding to width size information of the sheet to be passed through the fixing device, which is inputted from the external host device 200 is detected by the second photo-sensor 40. As a result, the left and right shutters 37L and 37R are moved to open or close the openings.

Then, at the time when the edge portion of the sensor flag 39 corresponding to width size information of the sheet which is to be used and passed through the fixing device is detected, with the time as a starting point, the shutter motor M is driven for several msec and is stopped. As a result, the left and right shutters 37L and 37R are moved to positions corresponding to the width of the sheet which is to be used and passed through the fixing device.

In the case where there is no need to perform cooling by the cooling fans 33L and 33R as in the case where the sheet to be used and passed through the fixing device has a maximum width size, the left and right shutters 37L and 37R are moved to full-close positions (close positions) as shown in FIG. 4. That is, the air blowing openings 31L and 31R of the left and right ducts 32L and 32R are closed over full width. As a result, it is possible to prevent a malfunction of the cooling fans 33L and 33R due to radiant heat from the film 13.

Incidentally, in this embodiment, a construction in which the air blowing openings 31L and 31R are sufficiently closed at the full-close positions of the shutters 37L and 37R was employed, but a state in which a slight clearance is left in each of the air blowing openings 31L and 31R may also be used as the close position. That is, in movable ranges of the left and right shutters 37L and 37R by control of the control circuit portion 100, states in which the air blowing openings 31L and 31R are most closed are defined as the close positions.

In the case where the sheet to be used and passed through the fixing device has a minimum width size, the left and right shutters 37L and 37R are moved to full-open positions (open positions) as shown in FIG. 5. That is, the air blowing openings 31L and 31R of the left and right ducts 32L and 32R are open over full width.

Incidentally, in this embodiment, a construction in which the air blowing openings 31L and 31R are completely open at the full-open positions of the shutters 37L and 37R was employed, but a state in which a part of each of the air blowing openings 31L and 31R is slightly closed may also be used as the open position. That is, in movable ranges of the left and right shutters 37L and 37R by control of the control circuit portion 100, states in which the air blowing openings 31L and 31R are most open are defined as the open positions.

Further, in the case where the sheet to be used and passed through the fixing device has a width size narrower than the maximum width size and broader than the minimum width size, the left and right shutters 37L and 37R are moved to positions where widths of the air blowing openings 31L and 31R are adjusted to opening widths corresponding to the width of the sheet P to be passed through the fixing device.

(2) Cooling Fan Operation

An operation of the left and right cooling fans 33L and 33R will be described. During image formation, in the case where sheets smaller in width than a size of maximum width sheets usable in and passable through the fixing device 6 are continuously fixed by the fixing device 6, the temperature in the non-sheet-passing regions R (part (a) of FIG. 5) increases. The third and fourth thermistors 19*b* and 19*c* detect an inner surface temperature of a film portion corresponding the non-sheet-passing regions R.

The control circuit portion 100 controls the shutter motor driving circuit 400 when the thermistors 19*b* and 19*c* detect a predetermined certain temperature, so that the left and right shutters 37L and 37R are moved by the shutter motor M to positions corresponding to the width of the sheet. Further, the control circuit portion 100 controls a cooling fan driving circuit 500, so that an operation of the cooling fans 33L and 33R is started. As a result, the non-sheet-passing region temperature rise of the film 13 is suppressed.

Then, when a detection temperature of the third thermistor 19*b* is lowered to the predetermined certain temperature by cooling the non-sheet-passing regions of the film 13 by cooling air of the cooling fans 33L and 33R, the control circuit portion 100 stops the operation of the cooling fans 33L and 33R.

A temperature range of ON-OFF control of the cooling fans 33L and 33R depending on the detection temperature of the thermistors 19*b* and 19*c* is controlled so as to be changed depending on a status of the operation of the cooling fans 33L and 33R. The temperature range of ON-OFF control of the cooling fans 33L and 33R in this embodiment is controlled in the following manner in the case where, for example, B4-size sheets are continuously passed through the fixing device 6.

That is, during sheet passing, when the detection temperature of the thermistors 19*b* and 19*c* reaches 200° C. (operation start temperature), the operation of the cooling fans 33L and 33R is started. Then, when the detection temperature of the thermistors 19*b* and 19*c* decreases to 190° C. (operation stop temperature), the operation of the cooling fans 33L and 33R is stopped.

Further, the temperature range of the ON-OFF control of the cooling fans 33L and 33R depending on the detection temperature of the sub-thermistors 19*b* and 19*c* can also be controlled so as to be changed depending on a size and a basis weight of the sheet used.

(3) Shutter Opening and Closing Operation Sequence

A shape of an edge portion of the plurality of sensor flags 39 provided on one shutter 37R and determined correspondingly to sheets with various width sizes, and an opening and closing operation sequence, of the shutters 37L and 37R, using the shape will be described.

The left and right shutters 37L and 37R are connected by the rack-pinion mechanism 41 as described above, and move integrally with each other so as to adjust the opening widths of the air blowing openings 31L and 31R of the left and right ducts 32L and 32R in a similar manner. Therefore, in the following, the right-side shutter 37R provided with the sensor flags 39 will be described as a representative.

Part (a) of FIG. 1 shows a shape of the edge portion of the plurality of sensor flags 39 disposed on the shutter 37R. Part (b) of FIG. 1 shows a positional relationship between the photo-sensor 40 and the edge portion of the sensor flags 39 when the shutter 37R stops at a home position (during full-close of the shutter). Part (c) of FIG. 1 shows a positional relationship between the photo-sensor 40 and the edge portion of the sensor flags 39 during full-open of the shutter. In parts (b) and (c) of FIG. 1, I to VII represent positions of the plurality of sensor flags 39, respectively.

A width a1 of the sensor flag 39, for the shutter 37R, disposed immediately before the shutter 37R reaches the home position is smaller than widths a2 and a3 of other sensor flags 39 (part (a) of FIG. 1). FIG. 9 shows switching between the ON signal and the OFF signal which are outputted by the photo-sensor 40 when the shutter 37R is moved by reverse rotation drive of the shutter motor M from the full-open position of part (c) of FIG. 1 to the full-close position of part (c) of FIG. 1 with respect to the positions I to VII of the plurality of sensor flags 39.

As described above, the width a1 of the sensor flag 39 disposed immediately before the shutter 37R reaches the home position (full-close position) is made smaller than the widths a2 and a3 of other sensor flags 39.

As a result, in the case where the shutters 37L and 37R are moved by the shutter motor M, the following is enabled. That is, a time T1 from a start of detection of the OFF signal by the photo-sensor 40 to switch of the OFF signal to the ON signal can be made shorter than times T2 and T3 from a start of detection of the OFF signal by other edges to switch of the OFF signal to the ON signal.

The control circuit portion 100 monitors the time from the start of detection of the OFF signal by the photo-sensor 40 to switch of the OFF signal to the ON signal while moving the shutters 37, whereby the home position can be reliably detected with no confusion with other shutter positions.

Here, in a process in which the shutter 37R moves from the full-open position toward the home position, a time when the output signal of the photo-sensor 40 is switched from the ON signal to the OFF signal immediately before the shutter position reaches the home position is $T\alpha 1$. Then, a time when the output signal is switched from the OFF signal to the ON signal is $T\beta 1$. In this case, the time T1 from the start of detection of the OFF signal to the switch of the OFF signal to the ON signal is $T1=T\beta 1-T\alpha 1$.

On the other hand, the switching times T2 and T3 by other edges are $T2=T\beta 2-T\alpha 2$ and $T3=T\beta 3-T\alpha 3$. A time when the output signal of the photo-sensor 40 is switched from the ON signal to the OFF signal is $T\alpha 2$, and a time when the output signal is subsequently switched from the OFF signal to the ON signal is T132. Further, a time when the output signal of the photo-sensor 40 is switched from the ON signal to the OFF signal is $T\alpha 3$, and a time when the output signal is subsequently switched from the OFF signal to the ON signal is $T\beta 3$.

By using a relationship among shapes of the sensor flags 39 of the shutter 37R, opening and closing control of the shutters 37L and 37R is carried out in the following manner. This control will be described using a flowchart of FIG. 10 and a block diagram of a control system of FIG. 8.

1) When the image forming apparatus A starts a stand-by operation in which the image forming apparatus A awaits input of an image forming job (9-1), first, the control circuit portion 100 causes the shutter motor M to be rotationally driven normally in order to move the shutters 37L and 37R in an open direction (9-2).

2) In the case where the photo-sensor 40 is ON (i.e., outputs the ON signal) at the time of starting the stand-by operation, the shutter motor M is continuously rotated normally, and when OFF is detected and then ON is detected again (9-3), the shutter motor M is rotationally driven normally for several msec from the time and then is stopped (9-5). The case where the photo-sensor 40 is ON at the time of starting the stand-by operation is, for example, the case where the shutter 37R stops at the position IV or VI of FIG. 1. Incidentally, "several msec" refers to a predetermined time such that a detection theory of the photo-sensor 40 is not switched.

Further, in the case where the photo-sensor 40 is OFF (i.e., outputs the OFF signal) at the time of starting the stand-by operation, the shutter motor M is continuously rotated normally, and when ON is detected (9-4), the shutter motor M is rotationally driven normally for several msec from the time and then is stopped (9-5). The case where the photo-sensor 40 is OFF at the time of starting the stand-by operation is, for example, the case where the shutter 37R stops at the position III, V or VII of FIG. 1.

Incidentally, "several msec" refers to a predetermined time such that a detection theory of the photo-sensor 40 is not switched, and is the same time as in the case of (9-3). By (9-3), (9-4) and (9-5), the photo-sensor 40 opposes a position of several msec from the edge of the sensor flags 39 and is positioned in a light transmitted state (ON state).

However, in the case where the shutter 37R stops at the positions I and II at the time of starting the stand-by operation, at the position I, the photo-sensor 40 is kept in the OFF state, and at the position II, after OFF is positioned, the photo-sensor 40 is left in the OFF state as it is. In this case, a time-out time Tmax is set, and when OFF is continuously detected for that time or more, the sequence is forcedly shifted to an operation of (9-6). The time-out time Tmax is set at a time longer than the times T1, T2 and T3 shown in FIG. 9 (9-26 and 9-27).

3) Then, the control circuit portion 100 causes the shutter motor M to be rotationally driven reversely in order to move the shutters 37L and 37R in a close direction (9-6).

4) By continuously carrying out the reverse rotation drive, the state of the photo-sensor 40 is switched from the ON state of (9-5) to the OFF state. When the state of the photo-sensor 40 is changed from the OFF state to the ON state within a predetermined time (within the time T1 (msec) in this embodiment) from that time (9-8), the shutter motor M is rotationally driven reversely for several msec from that time and then is stopped (9-9). As a result, the shutters 37L and 37R are moved to the full-close position (home position), so that positioning of the shutters 37L and 37R at the home position is completed.

The above-described 1) to 4) are a positioning operation of the shutters 37L and 37R at the home position (HP), i.e., a close position positioning operation for positioning the shutter 37L and 37R at the close position.

Incidentally, in this embodiment, the predetermined time in (9-7) and (9-8) was set at the time T1 (msec) shown in FIG. 9. However, the predetermined time may only be required to be set at a time shorter than a switching time (the time T3 shown in FIG. 9 in this embodiment) of the sensor flag (located at the position III of FIG. 1 in this embodiment) providing the second shortest switching time from OFF to ON.

5) An image forming job is started (9-11), and then when the detection temperature of the inner surface of the film portion corresponding to the non-sheet-passing region R by the third and fourth thermistors (sub-thermistors) 19*b* and 19*c* (9-13), the shutter motor M is rotationally driven normally (9-14). As a result, the shutters 37L and 37R open and move toward the full-close position (home position).

Then, when the control circuit portion 100 detects the number of times of ON/OFF switching of the photo-sensor 40 corresponding to the width of the sheet P used and passed through the fixing device (9-16), the shutter motor M is driven for several msec and is stopped (9-17). As a result, the left and right shutters 37L and 37R are moved to positions where the air blowing openings 31L and 31R are adjusted to have the opening widths corresponding to the width of the sheet to be passed through the fixing device.

6) Then, the control circuit portion 100 controls the cooling fan driving circuit 500, so that the left and right cooling fans 33L and 33R are caused to start an operation thereof (9-18).

7) When the image forming job is ended (9-20), the control circuit portion 100 stops the left and right cooling fans 33L and 33R (9-21) and causes the shutter motor M is rotationally driven reversely (9-22). As a result, the shutters 37L and 37R move in the close direction. When the photo-sensor 40 is switched from OFF to ON within a predetermined time (within the time T1 (msec) shown in FIG. 9 in this embodiment) (9-24), the control circuit portion 100 causes the shutter motor M to be rotationally driven reversely only for several msec from that time and then stops the rotation of the shutter motor M (9-25). As a result, the shutters 37L and 37R are returned and moved to the full-close position (home position) and are in the stand-by state.

As described above, the width a1 of the sensor flag 39 disposed immediately before the sensor flag 37 reaches the home position is made smaller than the widths a2 and a3 of other sensor flags. In other words, an interval T1 of the OFF signal outputted by the photo-sensor 40 on the basis of the sensor flag detecting the close position of the shutter 37R is narrower than intervals T2 and T3 of the OFF signal outputted by the photo-sensor 40 on the basis of other sensor flags.

As a result, only by the single photo-sensor 40, even in the case where a main switch is turned OFF/ON, the home position of the shutter 37R is detectable. In addition, the shutter 37 can be moved reliably to a predetermined position corresponding to width size information of the sheet to be passed through the fixing device.

That is, the positioning of the shutter at the home position and opening and closing position control corresponding to the sheet width can be reliably performed by the single sensor, and therefore, it becomes possible to reduce a cost correspondingly to the single sensor.

Embodiment 2

In Embodiment 2, a structure of an image forming apparatus A and a basic structure of a fixing device 6 are similar to those of Embodiment 1 and therefore will be omitted from redundant description by adding common reference numerals or symbols to common portions. A difference between Embodiments 1 and 2 is in shape of an edge portion of a plurality of sensor flags 39 provided on one shutter 37 and in opening and closing sequence of shutters to 37L and 37R using the shape. In the following, the difference will be described using FIGS. 11-13.

Incidentally, the left and right shutters 37L and 37R are connected by the rack-pinion mechanism 41 similarly as Embodiment 1, and move integrally with each other so as to adjust the opening widths of the air blowing openings 31L and 31R of the left and right ducts 32L and 32R in a similar manner. Therefore, in the following, the right-side shutter 37R provided with the sensor flags 39 will be described as a representative.

(1) Shape of Edge Portion of Sensor Flags

Part (a) of FIG. 11 shows a shape of the edge portion of the plurality of sensor flags 39 disposed on the shutter 37R in Embodiment 2. Part (b) of FIG. 11 shows a positional relationship between the photo-sensor 40 and the edge portion of the sensor flags 39 when the shutter 37R stops at a home position (during full-close of the shutter). Part (c) of FIG. 11 shows a positional relationship between the photo-sensor 40 and the edge portion of the sensor flags 39 during full-open of the shutter. In parts (b) and (c) of FIG. 11, I to VII represent positions of the plurality of sensor flags 39, respectively.

In Embodiment 2, a clearance (recessed portion) width b1, between adjacent sensor flags, of the sensor flag 39, disposed immediately before the shutter 37R reaches the home position is smaller than clearance (recessed portion) widths a2 and a3 between other sensor flags 39 (part (a) of FIG. 11). FIG. 12 shows switching between the ON signal and the OFF signal which are outputted by the photo-sensor 40 when the shutter 37R is moved by reverse rotation drive of the shutter motor M from the full-open position of part (c)

of FIG. 11 to the full-close position of part (c) of FIG. 11 with respect to the positions I to VII of the plurality of sensor flags 39.

As described above, the recessed portion width a1, between adjacent sensor flags, of the sensor flag 39 disposed immediately before the shutter 37R reaches the home position (full-close position) is made smaller than the recessed portion widths a2 and a3 between other sensor flags 39.

As a result, as shown in FIG. 12, in the case where the shutters 37L and 37R are moved by the shutter motor M, the following is enabled. That is, a time t1 from a start of detection of the ON signal by the photo-sensor 40 to switch of the ON signal to the OFF signal can be made shorter than times t2 and t3 from a start of detection of the ON signal by other edges to switch of the ON signal to the OFF signal.

The control circuit portion 100 monitors the time from the start of detection of the ON signal by the photo-sensor 40 to switch of the ON signal to the OFF signal while moving the shutters 37, whereby the home position can be reliably detected with no confusion with other shutter positions.

Here, in a process in which the shutter 37R moves from the full-open position toward the home position, a time when the output signal of the photo-sensor 40 is switched from the OFF signal to the ON signal immediately before the shutter position reaches the home position is $t\alpha 1$. Then, a time when the output signal is switched from the ON signal to the OFF signal is $t\beta 1$. In this case, the time t1 from the start of detection of the ON signal to the switch of the ON signal to the OFF signal is $t1=t\beta 1-t\alpha 1$. On the other hand, the switching times t2 and t3 by other edges are $t2=t\beta 2-\tau a2$ and $t3=t\beta 3-t\alpha 3$. A time when the output signal of the photo-sensor 40 is switched from the OFF signal to the ON signal is $t\alpha 2$, and a time when the output signal is subsequently switched from the ON signal to the OFF signal is $t\beta 2$. Further, a time when the output signal of the photo-sensor 40 is switched from the OFF signal to the ON signal is $t\alpha 3$, and a time when the output signal is subsequently switched from the ON signal to the OFF signal is $t\beta 3$.

Here, also in Embodiment 2, similarly as in Embodiment 1, ON of the photo-sensor 40 is the output signal of the photo-sensor 40 in the state in which the photo-sensor 40 is not blocked by the sensor flags 39 (transmitted state), and OFF of the photo-sensor 40 is the output signal of the photo-sensor 40 in the state in which the photo-sensor 40 is blocked by the sensor flags 39 (blocked state).

(2) Shutter Opening and Closing Operation Sequence

In Embodiment 2, by using a relationship among shapes of the sensor flags 39 of the shutter 37R, opening and closing control of the shutters 37L and 37R is carried out in the following manner. This control will be described using a flowchart of FIG. 13 and a block diagram of a control system of FIG. 8.

1) When the image forming apparatus A starts a stand-by operation in which the image forming apparatus A awaits input of an image forming job (14-1), first, the control circuit portion 100 causes the shutter motor M to be rotationally driven normally in order to move the shutters 37L and 37R in an open direction (14-2).

2) In the case where the photo-sensor 40 is ON (i.e., outputs the ON signal) at the time of starting the stand-by operation, the shutter motor M is continuously rotated normally, and when OFF is detected (14-3), the shutter motor M is rotationally driven normally for several msec from the time and then is stopped (14-5). The case where the photo-sensor 40 is ON at the time of starting the stand-by operation is, for example, the case where the shutter 37R stops at the position II, IV or VI of FIG. 11. Incidentally, "several msec" refers to a predetermined time such that a detection theory of the photo-sensor 40 is not switched.

Further, in the case where the photo-sensor 40 is OFF (i.e., outputs the OFF signal) at the time of starting the stand-by operation, the shutter motor M is continuously rotated normally, and when ON is detected and then OFF is positioned again (14-4), the shutter motor M is rotationally driven normally for several msec from the time and then is stopped (14-5). The case where the photo-sensor 40 is OFF at the time of starting the stand-by operation is, for example, the case where the shutter 37R stops at the position III, V or VII of FIG. 11.

Incidentally, "several msec" refers to a predetermined time such that a detection theory of the photo-sensor 40 is not switched, and is the same time as in the case of (14-3). By (14-3), (14-4) and (14-5), the photo-sensor 40 is positioned in a light blocked state (OFF state) by a portion of several msec from the edge of the sensor flags 39.

However, in the case where the shutter 37R stops at the position I at the time of starting the stand-by operation, at the position I, the photo-sensor 40 is kept in the OFF state. In this case, a time-out time tmax is set, and when OFF is continuously detected for that time or more, the sequence is forcedly shifted to an operation of (14-6). The time-out time Tmax is set at a time longer than the times t1, t2 and t3 shown in FIG. 9 (14-26 and 14-27).

3) Then, the control circuit portion 100 causes the shutter motor M to be rotationally driven reversely in order to move the shutters 37L and 37R in a close direction (14-6).

4) By continuously carrying out the reverse rotation drive, the state of the photo-sensor 40 is switched from the OFF state of (14-5) to the ON state. When the state of the photo-sensor 40 is changed from the ON state to the OFF state within a predetermined time (within the time t1 (msec) shown in FIG. 12 in this embodiment) from that time (14-8), the shutter motor M is rotationally driven reversely for several msec and then is stopped (14-9). As a result, the shutters 37L and 37R are moved to the full-close position (home position), so that positioning of the shutters 37L and 37R at the home position is completed.

The above-described 1) to 4) are a positioning operation of the shutters 37L and 37R at the home position (HP).

Incidentally, in this embodiment, the predetermined time in (14-7) and (14-8) was set at the time t1 (msec) shown in FIG. 12. However, the predetermined time may only be required to be set at a time shorter than a switching time (the time T3 shown in FIG. 9 in this embodiment) of the sensor flag (located at the position II of FIG. 11 in this embodiment) providing the second shortest switching time from ON to OFF.

5) An image forming job is started (14-11). Then, when the detection temperature of the inner surface of the film portion corresponding to the non-sheet-passing region R by the third and fourth thermistors (sub-thermistors) 19*b* and 19*c* (14-13), the control circuit portion 100 rotationally drives the shutter motor M normally (14-14). As a result, the shutters 37L and 37R open and move toward the full-close position (home position).

Then, when the control circuit portion 100 detects the number of times of ON/OFF switching of the photo-sensor 40 corresponding to the width of the sheet P used and passed through the fixing device (14-16), the shutter motor M is driven for several msec and is stopped (14-17). As a result, the left and right shutters 37L and 37R are moved to positions where the air blowing openings 31L and 31R are adjusted to have the opening widths corresponding to the width of the sheet to be passed through the fixing device.

6) Then, the control circuit portion 100 controls the cooling fan driving circuit 500, so that the left and right cooling fans 33L and 33R are caused to start an operation thereof (14-18).

7) When the image forming job is ended (14-20), the control circuit portion 100 stops the left and right cooling fans 33L and 33R (14-21) and causes the shutter motor M is rotationally driven reversely (14-22). As a result, the shutters 37L and 37R move in the close direction. When the photo-sensor 40 is switched from ON to OFF within a predetermined time (within the time t1 (msec) in this embodiment) (14-24), the control circuit portion 100 causes the shutter motor M to be rotationally driven reversely only for several msec from that time and then stops the rotation of the shutter motor M (14-25). As a result, the shutters 37L and 37R are returned and moved to the full-close position (home position) and are in the stand-by state.

As described above, the recessed portion width b1, between adjacent sensor flags, of the sensor flag 39 disposed immediately before the sensor flag 37 reaches the home position is made smaller than the recessed portion widths b2 and b3 between other sensor flags. In other words, an interval t1 of the ON signal outputted by the photo-sensor 40 on the basis of the sensor flag detecting the close position of the shutter 37R is narrower than intervals t2 and t3 of the ON signal outputted by the photo-sensor 40 on the basis of other sensor flags.

As a result, similarly as in Embodiment 1, only by the single photo-sensor 40, even in the case where a main switch is turned OFF/ON, the home position of the shutter 37R is detectable. In addition, the shutters 37L and 37R can be moved reliably to a predetermined position corresponding to width size information of the sheet to be passed through the fixing device.

That is, the positioning of the shutter at the home position and opening and closing position control corresponding to the sheet width can be reliably performed by the single sensor, and therefore, it becomes possible to reduce a cost correspondingly to the single sensor.

Embodiment 3

The structure of an image forming apparatus A and the basic structure of the fixing device 6 are similar to those also in this embodiment (Embodiment 3) and therefore will be omitted from redundant description. In the following, a relationship between the sensor flag 39 and the photo-sensor 40, which is a feature of this embodiment will be described using FIGS. 14-16. In FIG. 14, as regards the air blowing cooling mechanism 30, in order to avoid complexity, only the left and right ducts 32L and 32R, cooling fans 33L and 33R and shutters 37L and 37R, and the sensor flag 39 are shown.

In this embodiment, contrary to the cases of Embodiments 1 and 2, the ON of the photo-sensor 40 is an output signal of a state (light blocked state) in which the photo-sensor 40 is blocked by the sensor flag 39. The OFF signal is an output signal of a state (light transmitted state) in which the sensor optical path of the photo-sensor 40 is not blocked by the sensor flag 39.

Part (a) of FIG. 14 shows a position where the left and right shutters 37L and 37R are sufficiently closed, i.e., a state in which the shutters 37L and 37R are in the home position (full-close position). In this state, the photo-sensor 40 is blocked by the sensor flag 39 (sensor signal: ON).

Further, part (b) of FIG. 14 shows a state in which the left and right shutters 37L and 37R are in a position where the shutters are fully opened. In this state, the photo-sensor 40 is not blocked by the sensor flag 39 and thus the light transmitted state is formed (sensor signal: OFF).

Thus, the sensor flag 39 is provided so that a detection state by the photo-sensor 40 is changed between opposite states (i.e., one is OFF and the other is OFF) between when the shutters are in the home position (full-close position) and when the shutters are in the full-open position.

In Embodiment 3, a construction in which in a state that the shutter 37R is in the home position as shown in part (a) of FIG. 14, the photo-sensor 40 is blocked by the sensor flag 39 and in which in a state that the shutter 37R is in the maximum open position as shown in part (b) of FIG. 14, the photo-sensor 40 permits light transmission was employed. However, this relationship may only be required to provide a detection state which is opposite between the home position (full-closed position) and the full-open position, and may also be changed to a relationship in which the photo-sensor 40 permits light transmission by the sensor flag 39 at the home position and is blocked by the sensor flag 39 at the maximum open position.

(Operation Sequence of Detection (Detecting) of Home Position of Shutters)

A shape of an edge portion of the plurality of sensor flags 39 provided on one shutter 37R and an opening and closing operation sequence, of the shutters 37L and 37R, using the shape in Embodiment 3 will be described. The left and right shutters 37L and 37R are connected by the rack-pinion mechanism 41 similarly as in Embodiments 1 and 2 and move integrally with each other so as to adjust the opening widths of the air blowing openings 31L and 31R of the left and right ducts 32L and 32R in a similar manner. Therefore, in the following, the right-side shutter 37R provided with the sensor flags 39 will be described as a representative.

The case where the shutter 37R is in the home position (full-close position) is shown in part (a) of FIG. 15, and the case where the shutter 37 is in the maximum open position (full-open position) is shown in part (b) of FIG. 15. In part (b) of FIG. 15, I to VIII represent positions of the plurality of sensor flags 39, respectively.

A recessed portion width b1 (part (b) of FIG. 15) of the sensor flag 39, for the shutter 37R, disposed immediately before the shutter 37R reaches the home position is smaller than recessed portion widths b2 and b3 of other sensor flags 39 (part (a) of FIG. 1).

The recessed portion width b1 is made smaller than other recessed portion widths b2 and b3.

As a result, in the case where the shutters 37L and 37R are moved by the shutter motor M, the following is enabled. That is, a time t1 from a start of detection of the OFF (transmitted state) by the photo-sensor 40 to switch of the OFF to the ON (blocked state) can be made shorter than times t2 and t3 from a start of detection of the OFF signal by other edges to switch of the OFF signal to the ON signal. Then, by using this difference in switching time, the control circuit portion 100 is capable of making discrimination that the shutter 37R moved to the home position in the case where the detection theory of the photo-sensor 40 is switched within a certain time (for example, within the time t1).

Incidentally, as a modified embodiment, in the case where the light transmitted state is formed at the home position, the width of the sensor flag 39 disposed immediately before the shutter 37R reaches the home position (full-close position) may only be required to be made smaller than the widths by other sensor flags 39.

As a result, on the basis of the time from the start of detection of the OFF signal (transmitted state) by the photo-sensor 40 to switch of the OFF signal to the ON signal (blocked state), the home position can be reliably detected with no confusion with other shutter positions.

This home position detecting operation of the shutter 37R using the shape relationship of the sensor flags 39 of the shutter 37R will be described using a flowchart of FIG. 17. This home position detecting operation and a shutter (detect) restoring sequence described later are carried out by the control circuit portion 100 (FIG. 8).

<8-1>

The home position detecting operation is started.

<8-2>

The shutter motor M is rotationally driven normally in order to move the shutters 37L and 37R in the open direction.

<8-3>

In the case where the photo-sensor 40 is in the ON state (the case where the shutter 37R stops at the position II, IV, VI or VIII of FIG. 16), whether or not the OFF state of the photo-sensor 40 is detected is checked.

<8-4>

Whether or not the OFF state is detected within a time Tx is checked.

<8-5>

In the case where the photo-sensor 40 is in the ON state even after a lapse of the time Tx, the sequence goes to the restoring operation sequence described later.

<8-6>

In the case where the OFF state is detected within the time Tx, subsequently, whether or not the ON state is detected is checked.

<8-7>

Whether or not the ON state is detected within a time tmax is checked.

<8-8>

At the time of starting the home position pressing operation, also in the case of OFF, the sequence goes to the operation of <8-7>.

<8-9>

In the case where the ON state is detected within the time tmax, the shutter motor M is stopped.

<8-10>

The shutter motor M is rotationally driven reversely.

<8-11>

Whether or not the OFF state is detected within the time Tx.

<8-12>

In the case where the ON state is kept even after a lapse of the time Tx, the sequence goes to the restoring operation sequence described later.

<8-13>

In the case where the OFF state is detected within the time Tx, subsequently, whether or not the ON state is detected within the time t1 is checked.

<8-14>

When the ON state is detected within the time t1, the shutter motor M is stopped, so that the operation is ended.

<8-15>

In the case where the OFF state is kept even after a lapse of the time t1, whether or not the OFF state is switched to the ON state within a thermistor Ty is checked. In the case where the OFF state is switched to the ON state, the sequence goes to <9-11> again.

<8-16>

In the case where the OFF state is kept even after a lapses of the time Ty, the sequence goes to the restoring operation sequence described later.

<8-17>, <8-18>, <8-19>

In <8-7>, in the case where the OFF state is kept even after the lapse of tmax, the shutter motor M is stopped and then is reversely rotated, so that the sequence goes to <8-15>.

The above is description of the home position detecting operation (close position detecting operation) sequence of the shutters 37L and 37R. The shutter 37R is moved in the open direction at least by the number of times of switching of the edge (portion) interval of the sensor flags for detecting the close position of the shutter 37R.

By using this method, it is possible to discriminate movement of the shutters 37L and 37R to the home position by using a difference in switching time of the photo-sensor 40.

As regards the time t1 in the sequence, the time when the state is switched from OFF to ON may only be required to be set at a time shorter than the second shortest switching time (t3 shown in FIG. 16 in this embodiment) from OFF to ON.

Next, the time tmax (time-out time) set at <8-7> of the above-mentioned sequence will be described. The reason why the time tmax is set is as follows. The OFF state is kept as it is after the state is switched from ON to OFF in the case where the shutter 37R stops at the position II of part (a) of FIG. 15 at the time of the start of the HP detecting operation of the shutter 37R, or is kept as it is in the case where the shutter 37R stops at the position I. By setting the time-out time tmax, when the OFF state is detected for that time or more, the operation is caused to be shifted to an operation in which the shutters 37L and 37R are forcedly moved in the close direction.

The time tmax may be a time substantially equal to the time t1 which is the switching time of the state of the position VII shown in FIG. 16. However, when the time tmax is set at a time shorter than t1, at an initial stage of the operation, in the case where the shutter 37R is in the position VII of FIG. 15, the operation goes to the closing operation before the position is switched to the position VII. For that reason, the switching of the position to the position VII which is the home position cannot be detected, so that the shutters cannot be moved to the home position. Therefore, there is a need to set the time tmax so as to be longer than at least the time t1. However, there is no need to set the time tmax so as to be longer than other times t2 and t3.

Alternatively, the time tmax is set at a through longer than the switching times t1, t2 and t3 in the states of VII, V and III shown in FIG. 16.

Further, in the sequence of FIG. 17, there is a need to set the time Tx (sec) at not less than an estimated maximum switching time (a maximum time of times t4, t5 and t6 of FIG. 16) from ON to OFF. Further, there is a need to set the time Ty (sec) at not less than an estimated maximum switching time (a maximum time of the times t1, t2 and t3 of FIG. 16).

Thus, in the construction in which the position of the shutter 37R is controlled by the single photo-sensor 40, the following operation is performed when the HP detection of the shutter 37 is made. That is, an initial movement amount of the shutter openings is set so that the edge of the sensor flag disposed immediately before the shutter 37R reaches the home position is switched. As a result, a range necessary to move the shutter 37R is reduced, so that it becomes possible to prevent complexity of the shutter structure.

(Shutter (Position) Restoring Operation Sequence)

The restoring operation sequence in the above-mentioned home position detecting operation will be described. As shown in part (a) of FIG. 14, in the case where the shutter 37R is in the home position (full-close position), the photo-sensor 40 detects the ON state. Further, as shown in part (b) of FIG. 14, in the case where the shutter 37R is in the maximum open position (full-open position), the photo-sensor 40 detects the OFF state. The shutter restoring operation sequence will be described using FIG. 18.

<1-1>

The shutter restoring operation sequence is started.

<1-2>

The detection theory of the photo-sensor 40 is checked, and when the ON state is detected, the shutter motor M is normally rotated.

<1-3>

Whether or not the OFF state is detected with in the time Tx is checked.

<1-4>

In the case where the OFF state is detected within the time Tx, the shutter motor M is stopped.

<1-5>

The sequence goes to the HP detecting operation.

<1-6>

In the case where the ON state is kept even after a lapse of the time Tx, the operation of the image forming apparatus A is stopped, an error is displayed at a display portion of an outputting portion (not shown) of the image forming apparatus A or at a display portion (not shown) of the external host device 200.

<1-7>

The detection theory of the photo-sensor 40 is checked at the time of starting the shutter restoring operation sequence, and when the ON state is detected, the shutter motor M is normally rotated.

<1-8>

Whether or not the ON state is detected with in the time Ty is checked.

<1-9>

In the case where the ON state is detected within the time Ty, the shutter motor M is stopped.

<1-10>

The sequence goes to the HP detecting operation.

<1-11>

In the case where the ON state is kept even after a lapse of the time Tx, the operation of the image forming apparatus A is stopped, an error is displayed at a display portion of an outputting portion (not shown) of the image forming apparatus A or at a display portion (not shown) of the external host device 200.

The above sequence is summarized as follows. The construction in which the detection theories of the photo-sensor 40 in a state that the shutters 37L and 37R are in the close position and in a state that the shutters 37L and 37R are in the open position where the air blowing openings 31L and 31R are sufficiently open is made different from each other. A restoring operation of the shutters 37L and 37R in the case of the same detection theory as in the state that the shutters 37L and 37R are in the close position moves the shutters 37L and 37R in the open direction. A restoring operation of the shutters 37L and 37R in the case of the same detection theory as in the state that the shutters 37L and 37R are in the open position moves the shutters 37L and 37R in the close direction.

The above is description of the shutter restoring operation sequence. A value of a current to the shutter motor M is made larger than that during the shutter opening and closing operation sequence and thus an output torque of the shutter motor M is increased, so that the restoring operation may also be tried.

Thus the detection theory of the sensor flag 39 for the photo-sensor 40 is made an opposite relationship between the case where the shutters 37L and 37R is in the home position and the case where the shutters 37L and 37R are in the maximum open position. Further, the rotational direction of the shutter motor M is determined during the restoring operation by the detection theory of the photo-sensor 40, so that the shutters 37L and 37R can be operated with reliably in a direction in which the detection theory of the photo-sensor 40 is changed. Therefore, in the restoring operation of the shutters 37L and 37R during operation abnormality, it becomes possible to prevent an unnecessary load to the respective driving gears and shutters.

Comparison Example 1

(1) Comparison Example 1

In Comparison Example 1, a fixing device 6 using two photo-sensors is shown in FIG. 19. In this example, shutters are moved to positions depending on a width size of sheets to be used and passed through the fixing device 6 as shown in FIG. 19.

In this fixing device 6, a first photo-sensor 40*a* for detecting that the shutters 37L and 37R are in predetermined full-close positions (reference positions: home positions) during OFF/ON of a voltage source of an image forming apparatus is provided. Further, in the fixing device 6, a second photo-sensor 40*b* for detecting the sensor flag 39 corresponding to width size information of sheets is provided. The shutters 37L and 37R are moved to predetermined positions depending on the sheet width size information by stopping the drive of the shutter motor M at predetermined switching timing of the sensor flag 39, on the shutter 37R, detected by the second photo-sensor 40*b*.

Incidentally, fixing device constructions other than this are similar to those of the fixing device 6 in the embodiments of the present invention and therefore will be omitted from redundant description by adding common reference numerals or symbols to common portions.

In a method using such two photo-sensors, there is a problem such that use of a plurality of photo-sensors leads to an increase in cost of an entirety of a main body of the fixing device.

(2) Comparison Example 2

Comparison Example 2 is a control method with a single photo-sensor. In this example, a method in which only a photo-sensor for detecting a home position of a shutter is provided and control is carried out by the number of rotation pulses of a shutter motor corresponding to width size information of sheets to be used and pressed through the fixing device.

In this method, in the case where the shutter motor causes a loss of synchronism by an accidental negative load and rotation of the shutter motor is stopped, there is a liability that an opening position of the shutter stops at a position which is not an assumed position and thus a state in which suppression of end portion temperature rise cannot be made is formed.

(3) Comparison Example 3

Also in Comparison Example 3, a control method with a single photo-sensor is employed. That is, in order to carry out control of shutters by the single photo-sensor, an interval of sensor flags, provided on the shutter, corresponding to width size information of sheets is optimized, so that an interval of the sensor flag disposed immediately before the shutter reaches the home position is made narrower than other intervals. Further, in the method, in the case where a switching time of the detection theory of the photo-sensor is switched within a predetermined time, the position is detected as the home position.

However, in the case where this technique is used, there is a problem in a restoring operation in the case where the shutter motor causes a loss of synchronism by an accidental negative load. In the case of using this technique, only by the detection theory of the photo-sensor, discrimination that the shutter is in any position cannot be made. For that reason, when the shutter motor is rotated in the same direction as the last operation, in the restoring operation again, the shutter is brought into operation although the shutter is in a state the shutters interfere with each other and are immovable due to a structure thereof.

For that reason, for example, as shown in part (a) of FIG. 20, in the case where an opening operation is performed in the restoring operation again when the shutters 37L and 37R are in maximum open positions as shown in part (a) of FIG. 20, there is a liability that constituent elements (component parts) such as respective driving gears and shutters are broken. Further, for example, in the case where the closing operation is performed when the shutters 37L and 37R are in the home positions as shown in part (b) of FIG. 20, there is a liability that the constituent elements such a the driving gears and shutters are broken.

OTHER EMBODIMENTS (1) In the above, the embodiments of the present invention were described, but numerical values of dimensions, conditions and the like mentioned in the above-described embodiments are examples, and therefore, the present invention is not limited thereto. The numerical values can be appropriately selected within a range to which the present invention is applicable. For example, fixing devices of a roller fixing type and an IH fixing type may also be used in combination with the air blowing cooling mechanisms as in the above-described embodiments.

(2) The film 13 in the fixing device 6 of the film heating type described in the above-mentioned embodiments is not limited to that having a construction in which an inner surface thereof is supported by the heater 11 and the heat-insulating holder 12 and the film 13 is driven by the pressing roller 20. For example, the film 13 may also be of a unit type in which the film 13 is stretched and extended around a plurality of rollers and is driven by either one of these rollers.

(3) The pressing member 20 forming the nip N in cooperation with the film 13 is not limited to a roller member. For example, a pressing belt unit (which is also the fixing member) including a belt stretched and extended around a plurality of rollers may also be used.

(4) The plurality of sensor flags 39 and the photo-sensor 40 as the detecting means for detecting the positions of the shutters may also be disposed so that the photo-sensor 40 is positioned on the shutter 37R and the sensor flags 39 are positioned on the shutter frame 35.

That is, the sensor flags 39 and the photo-sensor 40 which are the detecting means can be constituted so that one is disposed on the shutter 37R and the other is fixedly provided to the stationary member 35 and by light blocking and light transmission of the shutter optical path with relative movement between these members, the ON signal and the OFF signal are outputted.

A fixing device in which the sheets are fed by one side basis feeding may also be used. In this case, a single air blowing opening 31 is used.

(5) As the fixing device 6, the device for fixing the unfixed toner image formed on the sheet by heating the toner image was described as an example, but the present invention is not limited thereto. For example, a device for increasing a gloss (glossiness) of an image by heating and re-fixing a toner image temporarily fixed on the recording paper (also in this case, the device is referred to as the fixing device) may also be used. That is, for example, the fixing device 6 may also be a device for fixing the partly fixed toner image on the sheet or a device for subjecting the fixed image to a heating process. Accordingly, the fixing device 6 may also be, for example, a surface heating device (apparatus) for adjusting a gloss or a surface property of an image.

(6) The image forming apparatus described using the printer A as an example is not limited to the image forming apparatus for forming the monochromatic image but may also be an image forming apparatus for forming a color image. Further, the image forming apparatus can be carried out in various uses, such as a copying machine, a facsimile machine, and a multi-function machine having functions as these machines, by adding necessary device, equipment and casing structure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-078304 filed on Apr. 16, 2018, which is hereby incorporated by reference herein in its entirety.

What is claimed is:

1. An image heating apparatus comprising:

an image heating member configured to heat an image on a recording material, said image heating member having a longitudinal direction and at least one end portion with respect to the longitudinal direction;

an air blowing portion configured to blow air;

a duct configured to guide the air blown from said air blowing portion toward the end portion of said image heating member, said duct including an opening;

a shutter configured to open and to close the opening of said duct by sliding in the opening of said duct, said shutter having a closed position where the opening is fully closed;

a plurality of projections movable together with said shutter, each projection of said plurality of projections having a width in a movement direction of said plurality of projections, said plurality of projections including a smallest projection, the smallest projection having a width that is the smallest among widths of said plurality projections;

a detecting sensor configured to detect at least one projection of said plurality of projections; and a controller configured to control an operation of said shutter so that said controller stops said shutter at a predetermined position on the basis of detection of any one of said projections by said detecting sensor during opening of said shutter, and so that said controller stops said shutter on the basis of detection of the smallest projection by said detecting sensor during closing of said shutter to the closed position.

2. A image heating apparatus according to claim 1, wherein said air blowing portion includes an air blowing fan.

3. An image heating apparatus according to claim 1, wherein said image heating member has a first end portion and a second end portion with respect to the longitudinal direction of said image heating member, wherein said duct is provided with a first opening and a second opening to guide the air toward the first end portion and the second end portion of said image heating member, respectively, and wherein said shutter includes a first shutter and a second shutter provided in the first opening and the second opening, respectively.

4. An image heating apparatus according to claim 3, further comprising a driving mechanism configured to transmit a driving force to said first shutter and said second shutter.

5. An image heating apparatus according to claim 1, wherein said projections are formed integrally with said shutter.

6. An image heating apparatus according to claim 1, wherein said detecting sensor is a photo sensor configured to output an ON signal by light transmission on an optical path of said shutter and an OFF signal by light blocking on the optical path of said shutter.

7. An image heating apparatus according to claim 1, wherein the closed position of said shutter is a home position of said shutter.

8. An image heating apparatus according to claim 1, wherein said controller stops said shutter during opening of said shutter on the basis of detecting, by said detecting sensor, a projection of said plurality of projections that corresponds to a width of the recording material in a direction perpendicular to a feeding direction.

9. An image heating apparatus according to claim 8, further comprising a temperature detecting member configured to detect temperature of the end portion of said image heating member, wherein said controller controls the operation of said shutter on the basis of an output of said temperature detecting member.

10. An image heating apparatus comprising:

an image heating member configured to heat an image on a recording material, said image heating member having a longitudinal direction and at least one end portion with respect to the longitudinal direction;

an air blowing portion configured to blow air;

a duct configured to guide the air blown from said air blowing portion toward the end portion of said image heating member, said duct including an opening;

a shutter configured to open and to close the opening of said duct by sliding in the opening of said duct, said shutter having a closed position where the opening is fully closed;

a plurality of recessed portions movable together with said shutter, each recessed portion of said plurality of recessed portions having a width in a movement direction of said plurality of recessed portions, said plurality of recessed portions including a smallest recessed portion, the smallest recessed portion having a width that is the smallest among widths of said recessed portions a detecting sensor configured to detect at least one recessed portion of said plurality of recessed portions; and a controller configured to control an operation of said shutter so that said controller stops said shutter at a predetermined position on the basis of detection of any one of said recessed portions by said detecting sensor during opening of said shutter, and so that said controller stops said shutter on the basis of detection of the smallest recessed portion by said detecting sensor during closing of said shutter to the closed position.

11. A image heating apparatus according to claim 10, wherein said air blowing portion includes an air blowing fan.

12. An image heating apparatus according to claim 10, wherein said image heating member has a first end portion and a second end portion with respect to the longitudinal direction of said image heating member, wherein said duct is provided with a first opening and a second opening to guide the air toward the first end portion and the second end portion of said image heating member, respectively, and wherein said shutter includes a first shutter and a second shutter provided in the first opening and the second opening, respectively.

13. An image heating apparatus according to claim 12, further comprising a driving mechanism configured to transmit a driving force to said first shutter and said second shutter.

14. An image heating apparatus according to claim 10, wherein said recessed portions are formed integrally with said shutter.

15. An image heating apparatus according to claim 10, wherein said detecting sensor is a photo sensor configured to output an ON signal by light transmission on an optical path of said shutter and an OFF signal by light blocking on the optical path of said shutter.

16. An image heating apparatus according to claim 10, wherein the closed position of said shutter is a home position of said shutter.

17. An image heating apparatus according to claim 10, wherein said controller stops said shutter during opening of said shutter on the basis detecting, by said detecting sensor, a recessed portion of said plurality of recessed portions that corresponds to a width of the recording material in a direction perpendicular to a feeding direction.

18. An image heating apparatus according to claim 17, further comprising a temperature detecting member configured to detect temperature of the end portion of said image heating member, wherein said controller controls the operation of said shutter on the basis of an output of said temperature detecting member.

* * * * *